US010377615B2

(12) United States Patent
Turnbull et al.

(10) Patent No.: US 10,377,615 B2
(45) Date of Patent: Aug. 13, 2019

(54) SECTIONAL HYDRAULIC VALVE AND A TRUCK MOUNTED FORKLIFT INCORPORATING THE VALVE

(71) Applicants: Kevin Turnbull, Knockbridge (IE); Luca Taddia, Reggio Emilia (IT); Stefano Guerrieri, Reggio Emilia (IT)

(72) Inventors: Kevin Turnbull, Knockbridge (IE); Luca Taddia, Reggio Emilia (IT); Stefano Guerrieri, Reggio Emilia (IT)

(73) Assignees: Cargotec Research & Development Ireland Limited, County Louth (IE); Bucher Hydraulics SpA, Reggio Emilia (IT)

( * ) Notice: Subject to any disclaimer, the term of this patent is extended or adjusted under 35 U.S.C. 154(b) by 313 days.

(21) Appl. No.: 15/476,268

(22) Filed: Mar. 31, 2017

(65) Prior Publication Data

US 2017/0283227 A1 Oct. 5, 2017

(30) Foreign Application Priority Data

Mar. 31, 2016 (EP) ..... 16163462

(51) Int. Cl.
*B66F 9/075* (2006.01)
*B66F 9/22* (2006.01)
(Continued)

(52) U.S. Cl.
CPC ..... *B66F 9/07563* (2013.01); *B66F 9/22* (2013.01); *F15B 13/0402* (2013.01);
(Continued)

(58) Field of Classification Search
CPC .... B66F 9/07563; B66F 9/22; F15B 13/0402; F15B 13/043; F15B 13/0832; F15B 13/0839; F15B 13/0896; F15B 2211/3059
See application file for complete search history.

(56) References Cited

U.S. PATENT DOCUMENTS 4,826,474 A 5/1989 Holmes
6,024,535 A * 2/2000 Dubosh ..... B66F 9/07563 414/462

(Continued)

FOREIGN PATENT DOCUMENTS

DE 10 2013 017 093 A1 4/2015
EP 1 471 263 A1 10/2004

OTHER PUBLICATIONS

Extended European Search Report dated Oct. 25, 2016 from related European Patent Application No. 16163462.1 (7 pages).

*Primary Examiner* — Kaitlin S Joerger

(74) *Attorney, Agent, or Firm* — Brian J. Colandreo; Jeffrey T. Placker; Holland & Knight LLP

(57) ABSTRACT

This invention relates to a sectional hydraulic valve and a truck mounted forklift incorporating the distributor. The sectional hydraulic valve comprises an inlet cover, a plurality of hydraulic sections and an end cap. The hydraulic sections each having a pump gallery, a tank gallery, an A port, a B port, a spool and a remote pilot gallery. The end cap comprises a pump port coupled to the pump gallery, a tank port coupled to the tank gallery and a connecting conduit between the pump port and the tank port. The end cap further comprises a remote pilot gallery port coupled to the remote pilot gallery, a fluid passageway between the remote pilot gallery port and the connecting conduit, and a valve assembly operable to selectively permit or restrict flow of hydraulic fluid between the connecting conduit in the end cap and the remote pilot gallery in the hydraulic section.

19 Claims, 25 Drawing Sheets

(51) Int. Cl.
*F15B 13/08* (2006.01)
*F15B 13/04* (2006.01)
*F15B 13/043* (2006.01)

(52) U.S. Cl.
CPC ..... *F15B 13/043* (2013.01); *F15B 13/0832* (2013.01); *F15B 13/0839* (2013.01); *F15B 13/0896* (2013.01); *F15B 2211/3059* (2013.01)

(56) References Cited

U.S. PATENT DOCUMENTS 6,314,997 B1 11/2001 Yamashita
6,430,922 B2 * 8/2002 Tohji ..... E02F 9/2225 60/421
7,131,453 B2 * 11/2006 Toji ..... F15B 11/17 137/15.18
7,632,054 B2 * 12/2009 McGrane ..... B66F 9/07559 414/475
8,858,153 B2 * 10/2014 McGrane ..... B66F 9/07581 414/462
9,409,754 B2 * 8/2016 McGrane ..... B60L 53/14
9,494,171 B2 * 11/2016 Kobayashi ..... F15B 13/0842
9,657,461 B2 * 5/2017 Hashimoto ..... F15B 11/16
9,903,097 B2 * 2/2018 Hashimoto ..... F15B 11/16
9,932,994 B2 * 4/2018 Hashimoto ..... F15B 13/0402

* cited by examiner

SECTIONAL HYDRAULIC VALVE AND A TRUCK MOUNTED FORKLIFT INCORPORATING THE VALVE

RELATED APPLICATIONS

This Application is based on and claims the benefit of priority from European Patent Application No. 16163462.1, filed 31 Mar. 2016, the entire disclosure of which is incorporated herein by reference.

TECHNICAL FIELD OF THE INVENTION

This invention relates to a sectional hydraulic valve and a truck mounted forklift incorporating such a valve.

BACKGROUND OF THE INVENTION

Sectional hydraulic valves are commonly used on truck mounted forklifts and other load handling vehicles where a hydraulic pump is used to deliver hydraulic fluid to a plurality of hydraulic cylinders. The sectional hydraulic valve may be configured to deliver the hydraulic fluid to two or more of the plurality of cylinders simultaneously and indeed may be configured to prioritize the supply of hydraulic fluid to one or more of the cylinders. European Patent Application Publication No. EP1,471,263, in the name of Kobelco Construction Machinery Co., Ltd, discloses a hydraulic valve device and method of assembling the same.

Sectional hydraulic valves are particularly effective in truck mounted forklifts as the valves are relatively compact and relatively lightweight compared with alternative arrangements, both of which are very important considerations in the design of any component for a truck mounted forklift. Furthermore, the truck mounted forklifts often require simultaneous operation of several hydraulic cylinders at once and the sectional hydraulic valves provide a relatively simple and straightforward solution to the problem of distributing the hydraulic fluid to each of the cylinders while ensuring safe and smooth operation of the truck mounted forklift.

In recent years, truck mounted forklift manufacturers have developed remote control systems to allow limited operation of their forklift machines without an operator in the driver's station. These systems are deemed advantageous from a health and safety point of view as the operator may now mount and dismount the forklift from the rear of a carrying vehicle without having to board or alight from the forklift when the forklift is at height on the rear of a carrying vehicle. This obviates the possibility of the operator falling from height before, during or after the mounting or dismounting operation.

There are however problems with the remote control systems that allow limited operation of the forklift machines and more specifically the hydraulic configurations used with these remote control systems. First of all, additional valves and hoses are required and in some systems an electric motor pump separate from the main engine driven hydraulic pump are needed to pressurise the hydraulic fluid to operate the cylinders in remote control mode. The pump and valves are expensive and add weight to the truck mounted forklift. More importantly though, the hydraulic fluid pressurised by these valves and pump must be fed to the hydraulic lines of the cylinders and this requires an external connection into the hydraulic lines from the sectional hydraulic valve and a number of other connections between the additional valves and electric motor and pump. Each of these connections introduces a potential leak point for hydraulic fluid which is highly disadvantageous.

In addition to the foregoing, the hydraulic piping and connections required for the remote control system add weight and take up a substantial amount of space on the truck mounted forklift which is also highly disadvantageous due to the compact nature of these machines. Generally speaking, the additional hydraulic piping and connections are tightly packed into the limited available space on the forklift truck making construction and repair of these components difficult and time consuming.

It is an object of the present invention to provide a sectional hydraulic valve that overcomes at least some of these problems and provides a useful choice to the consumer. It is a further object of the present invention to provide a truck mounted forklift that overcomes at least some of these problems and provides a useful choice to the consumer.

SUMMARY OF THE INVENTION

According to the invention there is provided a sectional hydraulic valve of the type comprising an inlet cover, a plurality of hydraulic sections and an end cap;

the hydraulic sections each having a pump gallery, a tank gallery, an A port, a B port, a spool for selectively coupling one of the A port and the B port to the pump gallery and the other of the A port and the B port to the tank gallery, a first remote pilot gallery, the first remote pilot gallery being operatively coupled to one of the A port and the B port of a first one of the hydraulic sections, and a second remote pilot gallery, the second remote pilot gallery being operatively coupled to the other of the A port and the B port of the first one of the hydraulic sections;

the end cap comprising a pump port coupled to the pump gallery, a tank port coupled to the tank gallery and a connecting conduit between the pump port and the tank port;

and in which the end cap further comprises:

a first remote pilot gallery port coupled to the first remote pilot gallery; a fluid passageway between the first remote pilot gallery port and the connecting conduit;

a second remote pilot gallery port coupled to the second remote pilot gallery; a second fluid passageway between the second remote pilot gallery port and the connecting conduit; and a valve assembly operable to selectively permit or restrict flow of hydraulic fluid between the connecting conduit in the end cap and the remote pilot galleries in the first one of the hydraulic sections.

By having a sectional hydraulic valve with such an end cap, hydraulic fluid can be delivered or vented through the remote pilot galleries and the sectional hydraulic valve will provide the necessary fluid passageways for the delivery or venting of hydraulic fluid to or from the cylinders during remote operation. This is all achieved internally in the sectional hydraulic valve without numerous additional external connections and without the spool on the section being manually operated. This significantly reduces the number of potential leak points on the forklift truck and simplifies the hydraulic piping arrangement on the machine, freeing up space and reducing weight. Furthermore, it is envisaged that by having this configuration, it will be possible to use the forklift's main hydraulic pump to supply the hydraulic fluid and an additional electric motor will not be required. This will reduce the forklift's weight, complexity and cost. In addition to the foregoing, by having such an arrangement, as hydraulic fluid is vented from one side of the cylinder, hydraulic fluid can simultaneously be delivered to the other side of the hydraulic cylinder. This will allow for more precise control of the cylinder's operation and will permit a wider range of operations to be performed.

In one embodiment of the invention there is provided a sectional hydraulic valve in which:

the hydraulic sections each comprise a third remote pilot gallery, the third remote pilot gallery being operatively coupled to one of the A port and the B port of a second one of the hydraulic sections; and a fourth remote pilot gallery, the fourth remote pilot gallery being operatively coupled to the other of the A port and the B port of the second one of the hydraulic sections; and the end cap further comprises:

a third remote pilot gallery port coupled to the third remote pilot gallery; a third fluid passageway between the third remote pilot gallery port and the connecting conduit;

a fourth remote pilot gallery port coupled to the fourth remote pilot gallery; a fourth fluid passageway between the fourth remote pilot gallery port and the connecting conduit; and the valve assembly being operable to selectively permit or restrict flow of hydraulic fluid between the connecting conduit in the end cap and the remote pilot galleries in the second one of the hydraulic sections.

In one embodiment of the invention there is provided a sectional hydraulic valve in which the first and third fluid passageways are led to a common valve in the valve assembly. In this way, the two cylinders can be controlled simultaneously and the size and weight of the end cap can be reduced.

In one embodiment of the invention there is provided a sectional hydraulic valve in which the second and fourth fluid passageways are led to a common valve in the valve assembly.

In one embodiment of the invention there is provided a sectional hydraulic valve in which the valve in the valve assembly comprises at least one spool.

In one embodiment of the invention there is provided a sectional hydraulic valve in which the at least one spool is operated by way of a dedicated solenoid.

In one embodiment of the invention there is provided a sectional hydraulic valve in which the valve assembly comprises a spool operable to selectively redirect the hydraulic fluid in the connecting conduit away from the tank port to one or more of the remote pilot galleries.

In one embodiment of the invention there is provided a sectional hydraulic valve in which there is provided a remotely controllable secondary actuator connected to the spool of another of the hydraulic sections. In this way, the other hydraulic section can be controlled using it's existing spool without requiring additional remote pilot galleries in the sectional hydraulic valve which could weaken the sectional hydraulic valve.

In one embodiment of the invention there is provided a sectional hydraulic valve in which the remotely controllable secondary actuator comprises a solenoid.

In one embodiment of the invention there is provided a sectional hydraulic valve in which:

the hydraulic sections each comprise a fifth remote pilot gallery, the fifth remote pilot gallery being operatively coupled to one of the A port and the B port of a third one of the hydraulic sections; and a sixth remote pilot gallery, the sixth remote pilot gallery being operatively coupled to the other of the A port and the B port of the third one of the hydraulic sections; and the end cap further comprises:

a fifth remote pilot gallery port coupled to the fifth remote pilot gallery; a fifth fluid passageway between the fifth remote pilot gallery port and the connecting conduit;

a sixth remote pilot gallery port coupled to the sixth remote pilot gallery; a sixth fluid passageway between the sixth remote pilot gallery port and the connecting conduit; and the valve assembly being operable to selectively permit or restrict flow of hydraulic fluid between the connecting conduit in the end cap and the remote pilot galleries in the third one of the hydraulic sections.

In one embodiment of the invention there is provided a truck mounted forklift for mounting on the rear of a vehicle, the truck mounted forklift comprising a u-shaped chassis having a pair of forwardly projecting side bars bridged by a rear crossbar, a wheel adjacent the forwardmost end of each of the side bars and a rear wheel mounted on the rear cross bar, a driver's station mounted to one side of the chassis, a motive power unit mounted on the other side of the chassis and a lifting assembly mounted on the chassis, the lifting assembly being operated by a plurality of hydraulic cylinders, a primary control panel for the hydraulics located internal the driver's station and a secondary control panel for control of the hydraulics located remotely from the primary control panel of the forklift truck, the secondary hydraulics control panel being positioned in a location accessible by a forklift operator in a position dismounted from the forklift, and in which the hydraulic fluid to and from the plurality of hydraulic cylinders is routed through the sectional hydraulic valve according to the invention.

By having such a forklift truck, the number of potential hydraulic leak points will be reduced dramatically. Furthermore, the construction and maintenance of the forklift will be significantly simplified. In addition to the foregoing, the space required for housing the hydraulic piping will be reduced and the overall weight of the machine will be reduced.

In one embodiment of the invention there is provided a truck mounted forklift in which the secondary control panel comprises an ignition switch and a switch to vent hydraulic fluid from the rod side of a lift cylinder and the rod side of a tilt cylinder of the lifting assembly using the sectional hydraulic valve.

In one embodiment of the invention there is provided a truck mounted forklift in which the secondary control panel comprises a switch to deliver hydraulic fluid to the rod side of the lift cylinder and the rod side of the tilt cylinder and vent hydraulic fluid from the bore side of the lift cylinder and the bore side of the tilt cylinder using the sectional hydraulic valve.

In one embodiment of the invention there is provided a truck mounted forklift in which the secondary control panel comprises a switch to deliver hydraulic fluid to the bore side of the lift cylinder and the bore side of the tilt cylinder and vent hydraulic fluid from the rod side of the lift cylinder and the rod side of the tilt cylinder using the sectional hydraulic valve.

In one embodiment of the invention there is provided a truck mounted forklift in which the secondary control panel comprises a switch to operate a remotely controllable secondary actuator connected to the spool of one of the hydraulic sections of the sectional hydraulic valve.

BRIEF DESCRIPTION OF THE DRAWINGS

The invention will now be more clearly understood from the following description of some embodiments thereof given by way of example only with reference to the accompanying drawings, in which:

FIG. 7(*b*) is a diagrammatic view of the flow of hydraulic fluid in the forklift and through the sectional hydraulic valve during a "lower and go" operation;

FIG. 11(*b*) is a diagrammatic view of the flow of hydraulic fluid in the forklift and through the sectional hydraulic valve during a "ground start" operation;

DETAILED DESCRIPTION OF THE INVENTION

Figure 1:
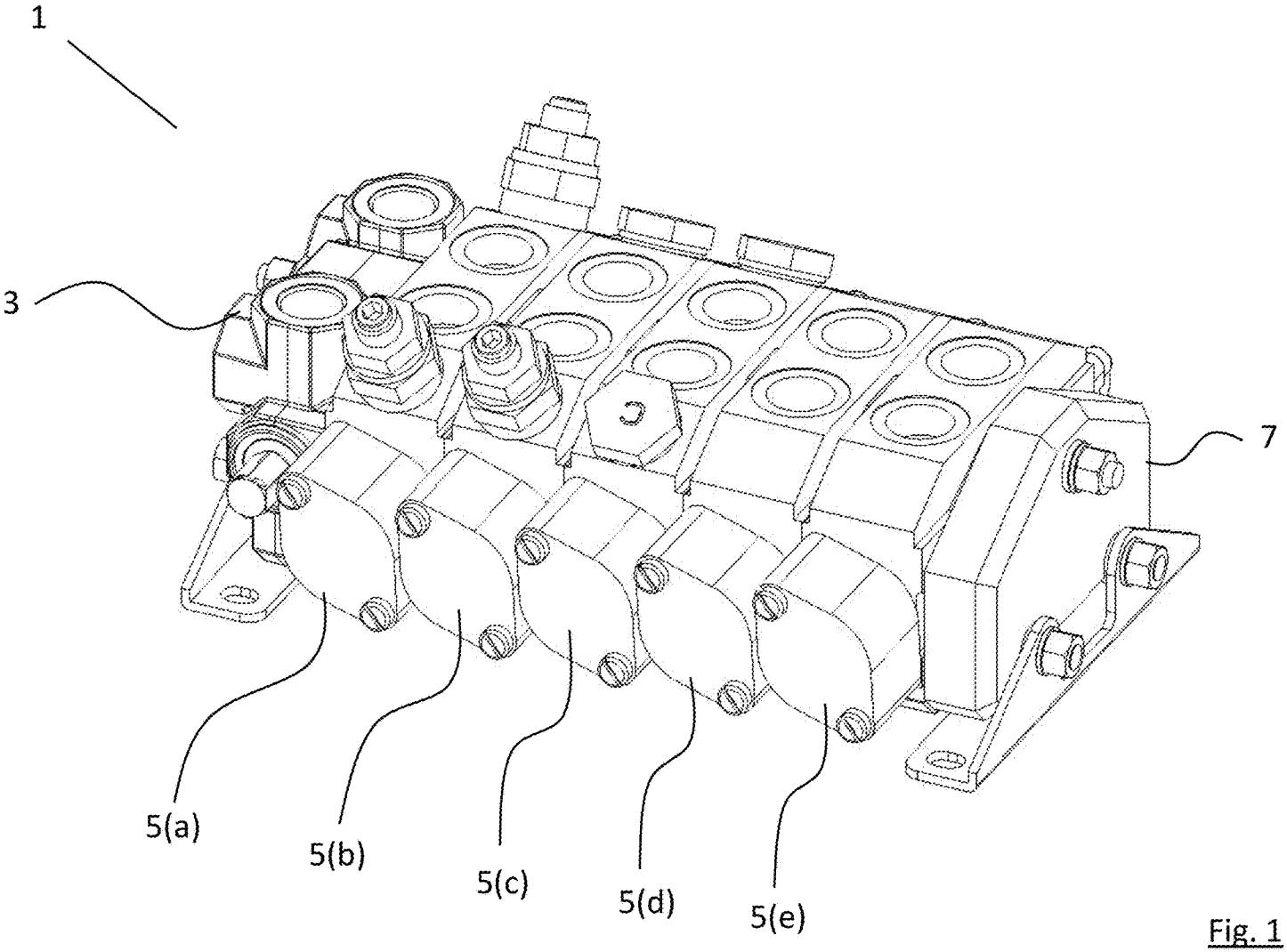
FIG. 1 is a perspective view of a sectional hydraulic valve known in the art.

Referring to FIG. 1, there is shown a sectional hydraulic valve known in the art, indicated generally by the reference numeral 1. The sectional hydraulic valve 1 comprises an inlet cover 3, a plurality of hydraulic sections 5(*a*)-5(*e*) and an end cap 7. The plurality of hydraulic sections are sandwiched between the inlet cover 3 and the end cap 7.

Figure 2:
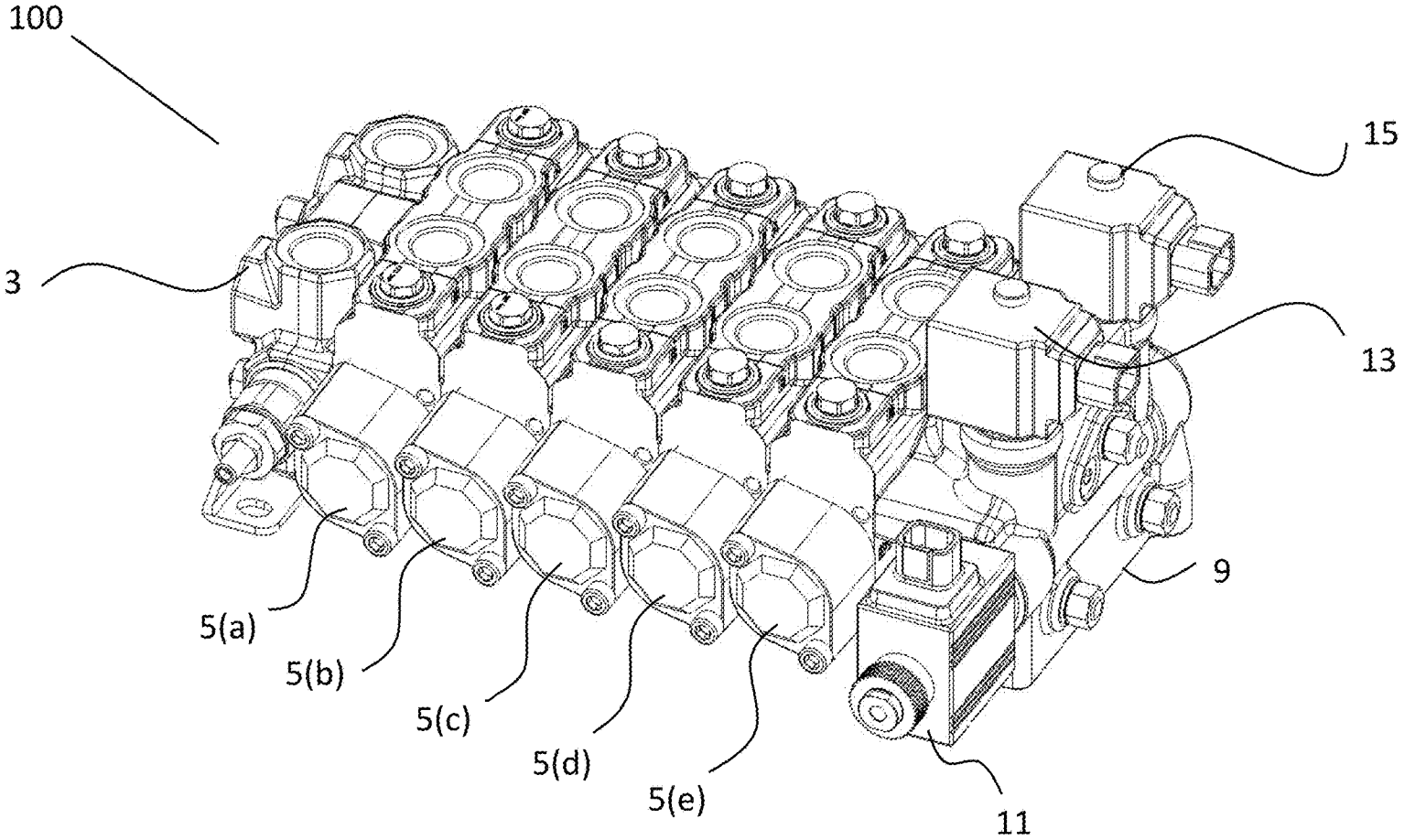
FIG. 2 is a perspective view of a sectional hydraulic valve according to the invention.

Referring to FIG. 2, there is shown a sectional hydraulic valve according to the invention, indicated generally by the reference numeral 100, where like parts have been given the same reference numeral as before. The sectional hydraulic valve 100 comprises an inlet cover 3, a plurality of hydraulic sections 5(*a*)-5(*e*) and an end cap 9. The end cap 9 differs from the end cap 7 in that the end cap 9 comprises a remote pilot gallery port (not shown), a fluid passageway (not shown) between the remote pilot gallery port and the connecting conduit (not shown), and a solenoid valve assembly 11, 13, 15 operable to selectively permit or restrict flow of hydraulic fluid between the connecting conduit in the end cap 9 and a remote pilot gallery (not shown) in the hydraulic section. The components of the hydraulic section and the internal components of the end cap will be explained in more detail below.

Figure 3:
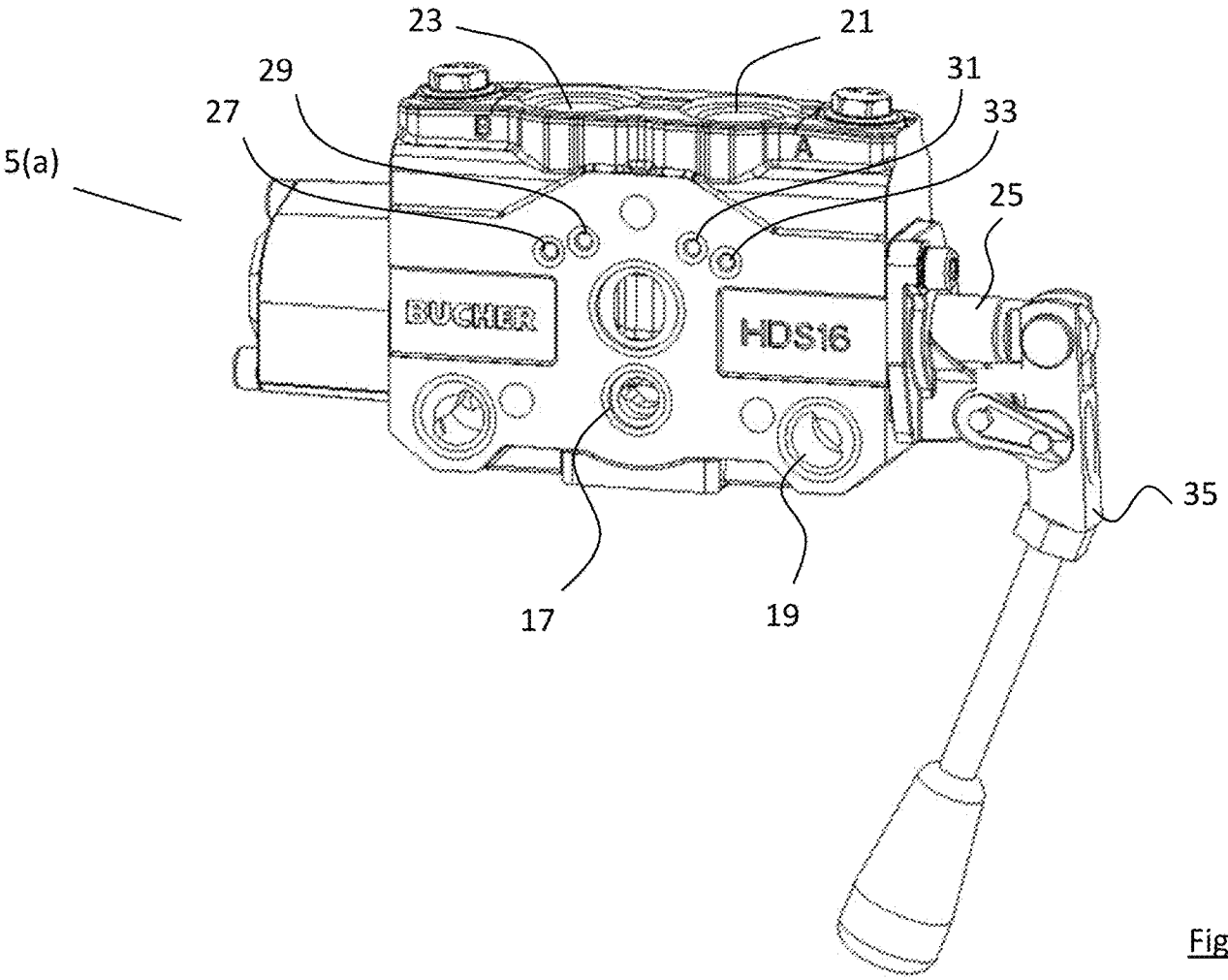
FIG. 3 is a perspective view of a hydraulic section of the sectional hydraulic valve according to the invention.

Referring to FIG. 3, there is shown a perspective view of a hydraulic section 5(*a*) of the sectional hydraulic valve according to the invention. The hydraulic section 5(*a*) comprises a pump gallery 17, a tank gallery 19, an A port 21, a B port 23, a spool 25 for selectively coupling one of the A port 21 and the B port 23 to the pump gallery 17 and the other of the A port and the B port to the tank gallery 19. Importantly, the hydraulic section 5(*a*) comprises a plurality of remote pilot galleries 27, 29, 31, 33. One of the remote pilot galleries 27, 29, 31, 33 may be operatively coupled to one of the A port and the B port of the hydraulic section 5(*a*) and another of the remote pilot galleries 27, 29, 31, 33 may be operatively coupled to the other of the A port and the B port of the hydraulic section 5(*a*). It can be seen that the spool 25 is operated by a push-pull lever 35. It will be understood that when a plurality of hydraulic sections 5(*a*)-5(*e*) are placed side by side, the pump gallery 17, the tank gallery 19 and the plurality of remote pilot galleries 27, 29, 31, 33 of each hydraulic section coincide with and are in communication with the pump gallery 17, the tank gallery 19 and the plurality of remote pilot galleries 27, 29, 31, 33 respectively of the adjacent hydraulic section.

Figure 4:
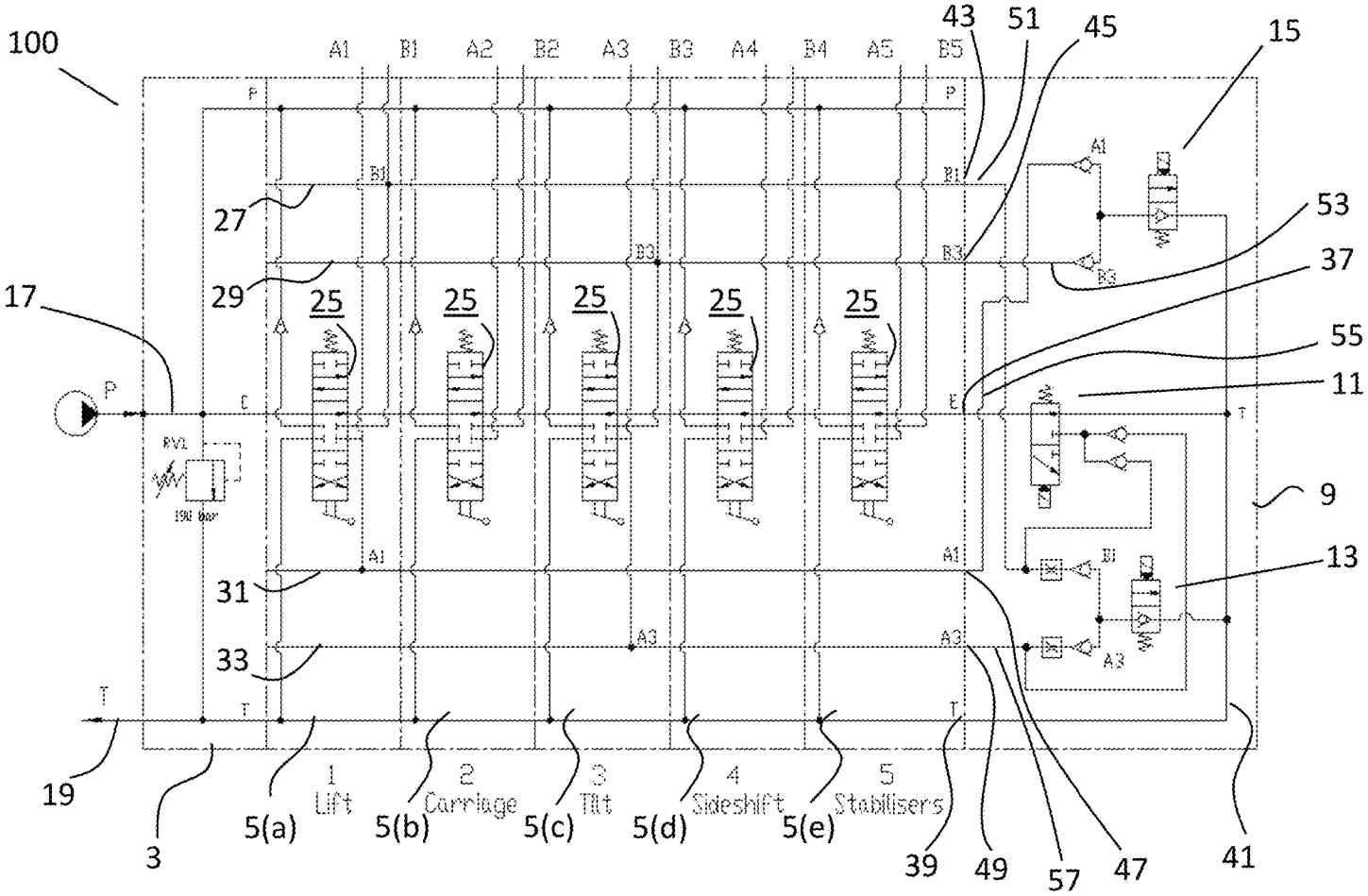
FIG. 4 is a schematic representation of the sectional hydraulic valve according to the invention in "neutral"

Referring now to FIG. 4, there is shown a schematic representation of the sectional hydraulic valve 100 according to the invention. In this embodiment, the sectional hydraulic valve 100 is in "neutral", permitting recirculation of hydraulic fluid from the pump gallery 17 back to the tank gallery 19 without redirecting the fluid as will be explained in more detail below.

The sectional hydraulic valve 100 shown in FIG. 4 is illustrative of a sectional hydraulic valve 100 for use in a truck mounted forklift. The hydraulic sections 5(*a*) to 5(*e*) inclusive are each dedicated to providing hydraulic fluid to a given type of cylinder (or cylinders if more than one cylinder is dedicated to a particular task) on the truck mounted forklift. For example, in the embodiment shown, hydraulic section 5(*a*) is dedicated to providing hydraulic fluid to the lift cylinder, hydraulic section 5(*b*) is dedicated to providing hydraulic fluid to the carriage cylinder, hydraulic section 5(*c*) is dedicated to providing hydraulic fluid to the tilt cylinder, hydraulic section 5(*d*) is dedicated to providing hydraulic fluid to the sideshift cylinder, and hydraulic section 5(*e*) is dedicated to providing hydraulic fluid to the stabiliser cylinders. The order and number of these sections can vary by model or country.

The internal configuration and porting of the end cap 9 can be seen in detail from FIG. 4. The end cap 9 comprises a pump port 37 coupled to the pump gallery 17 of the hydraulic sections 5(*a*)-5(*e*), a tank port 39 coupled to the tank gallery 19 of the hydraulic sections 5(*a*)-5(*e*), and a connecting conduit 41 between the pump port 37 and the tank port 39. The end cap 9 further comprises a plurality of remote pilot gallery ports 43, 45, 47, 49, each of which is in communication with one of the remote pilot galleries 27, 29, 31, 33. There is further provided a plurality of fluid passageways 51, 53, 55, 57 between the remote pilot gallery ports 43, 45, 47, 49 respectively and the connecting conduit 41. The end cap 9 further comprises the solenoid valve assembly 11, 13, 15 operable to selectively permit or restrict flow of hydraulic fluid between the connecting conduit 41 in the end cap 9 and one or more of the remote pilot galleries 27, 29, 31, 33 in the hydraulic sections 5(*a*)-5(*e*).

As mentioned above, the sectional hydraulic valve 100 as shown in FIG. 4 is in "neutral", permitting recirculation of hydraulic fluid from the pump, P, through the pump gallery 17 back to the tank T, through the tank gallery 19 without redirecting the fluid to one or more of the remote pilot galleries 27, 29, 31, 33 and without venting hydraulic fluid from any of the hydraulic sections 5(*a*)-5(*e*) through one or more of the remote pilot galleries 27, 29, 31, 33.

Valve assembly 11 comprises a two position spool. In the first valve assembly position as shown, the hydraulic fluid enters into end cap 9 through the pump port 37 and passes directly through the valve assembly 11. The hydraulic fluid then passes through the connecting conduit 41 back towards the tank port 39. The hydraulic fluid leaves the end cap 9 through the tank port 39 and passes into the tank gallery 19 and thereafter the hydraulic fluid will be returned to tank, T. The valve assemblies 13, 15 are bi-position spools that can toggle between a first "closed" configuration in which the valve assemblies 13, 15 prevent passage of fluid therethrough and a second "open" configuration in which the valve assemblies 13, 15 permit passage of fluid therethrough. In the embodiment shown in FIG. 4, both the valve assemblies 13, 15 are shown in a closed configuration preventing through passage of hydraulic fluid.

The operation of the sectional hydraulic valve 100 will be described with reference to specific remote control operations performed on a truck mounted forklift with reference to FIG. 5(*a*) to FIG. 16 inclusive below.

Figure 5A:
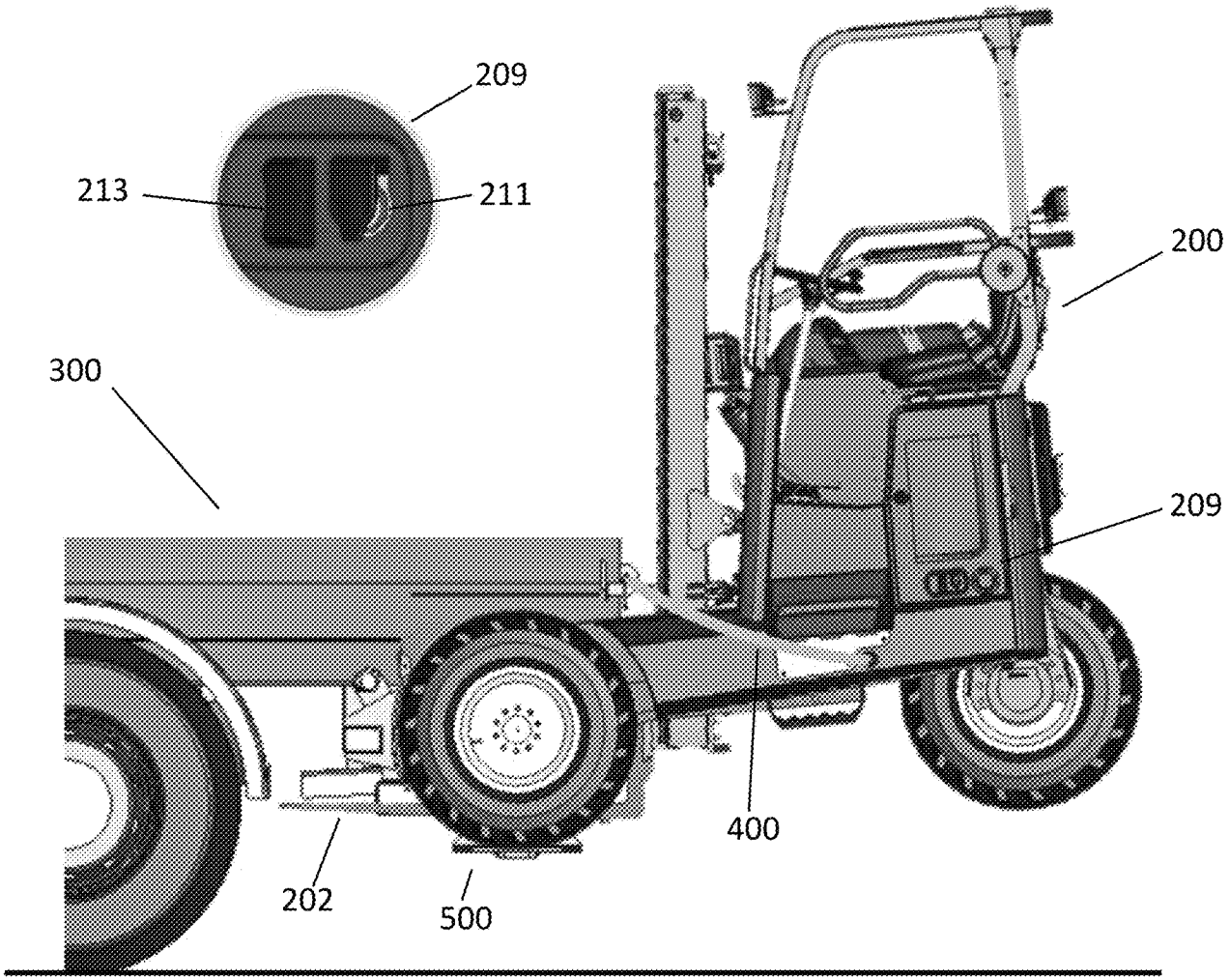
FIGS. 5(*a*) and 5(*b*) are diagrammatic views of a forklift demonstrating a "lower and go" operation.
Figure 5B:
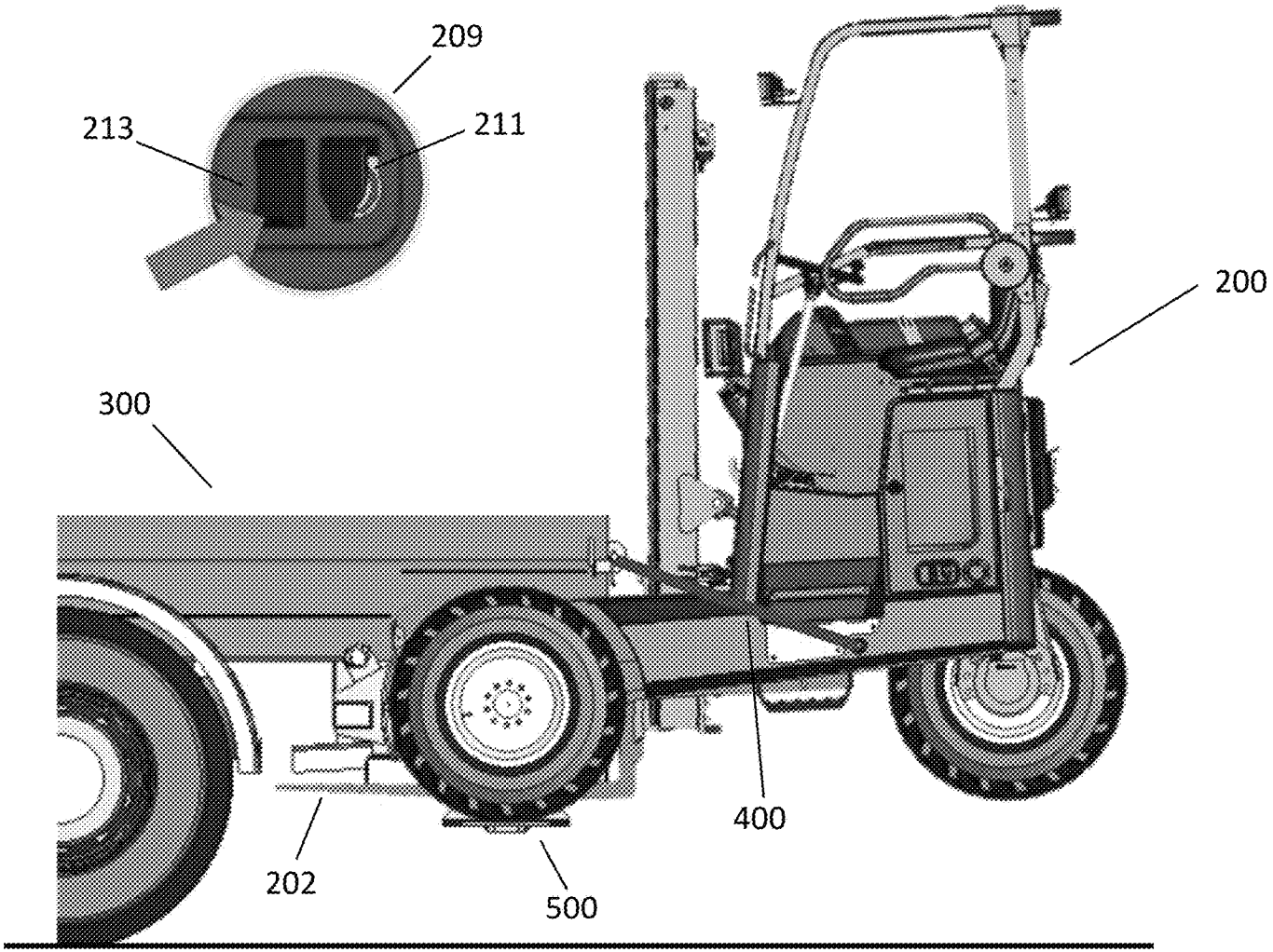

Referring first of all to FIGS. 5(*a*), 5(*b*) and 6, there is shown a "lower and go" operation carried out on a truck mounted forklift, indicated by the reference numeral 200, mounted on the rear of a carrying vehicle chassis 300. A "lower and go" operation is one where the forklift 200 has been mounted onto the rear of the carrying vehicle and prior to transit, the forklift is lowered slightly onto the vehicle and the mast is tilted forwards slightly to take at least some of the weight off the forks 202 and to place the weight of the forklift onto the chains 400 and wheel rest plates 500. This is achieved by venting some of the hydraulic fluid from the rod side 201 of the lift cylinder 203 and the rod side 205 of the tilt cylinder 207 (as shown in FIG. 6).

In FIGS. 5(*a*) and 5(*b*), the control panel 209 for remote control of the forklift is shown mounted on the side of the forklift in a position accessible to an operator (not shown) standing on the ground beside the machine and not in the driver's station. An enlarged view of the control panel is shown in the drawing and the control panel comprises an ignition switch 211 for the forklift engine and a toggle button 213 operable to control the valve assembly 13. The ignition switch is able to turn the engine on and off however typically the engine will be restricted to idling speed when started using this ignition switch for safety reasons. The engine at idling speed will however provide sufficient power to the pump P to operate the cylinders if needed.

In FIG. 5(*a*), the chains 400 (only one of which is shown however it will be understood that there will be provided a similar chain on the opposite side of the forklift 200 and the carrying vehicle 300) are connected to both the forklift 200 and the carrying vehicle chassis 300 but are slack. In FIG. 5(*b*), the chains 400 are still connected to both the forklift 200 and the carrying vehicle chassis 300 but are now taut, taking up some of the weight of the forklift.

Figure 6:
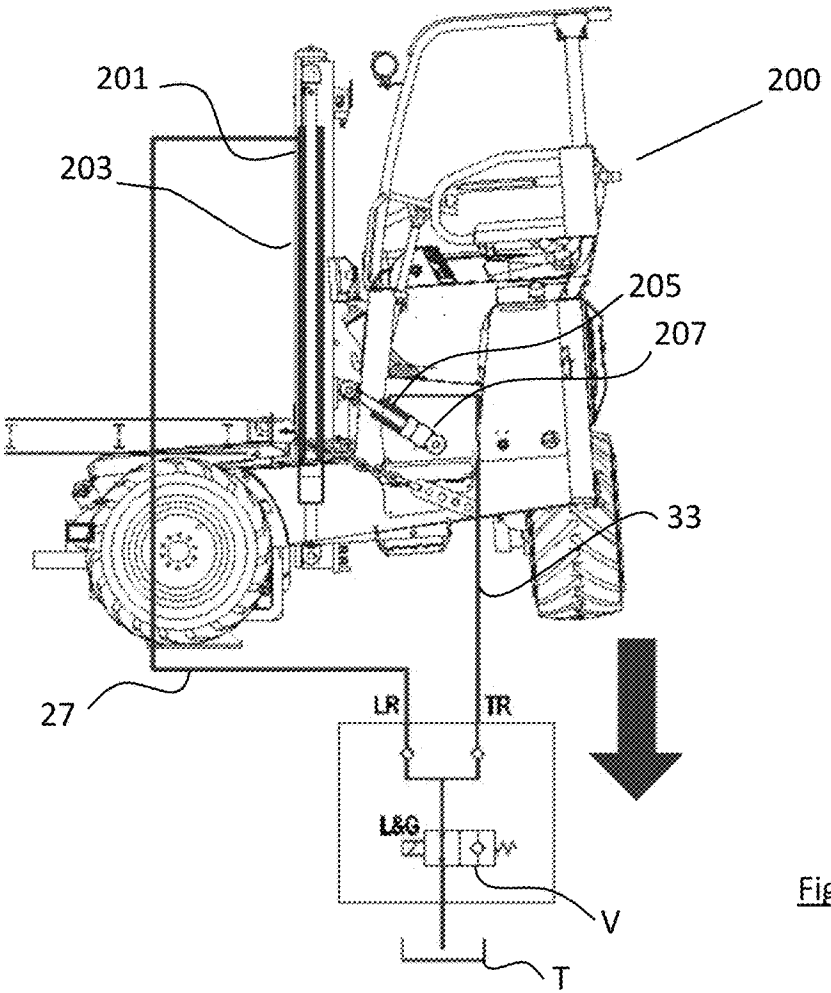
FIG. 6 is a diagrammatic view of the control of the hydraulics required to carry out a "lower and go" operation.

Referring specifically to FIG. 6, there is shown a simplified diagrammatic representation of the flow of hydraulic fluid required for a "lower and go" operation. It can be seen that the valve V has been toggled to an "open" configuration in which the valve V will permit passage of hydraulic fluid therethrough so that the hydraulic fluid can return to tank, T. In this configuration, the weight of the forklift will urge the forklift downwards and cause the forklift to pivot backwards (effectively drawing the rod of the tilt cylinder 207 out of the tilt cylinder). As the valve V is "open", hydraulic fluid under pressure in the rod side 201 of the lift cylinder 203 and the rod side 205 of the tilt cylinder 207 will be able to pass out of those cylinders 203, 207, back to the valve V and from there the hydraulic fluid is able to return to the tank T.

Figure 7A:
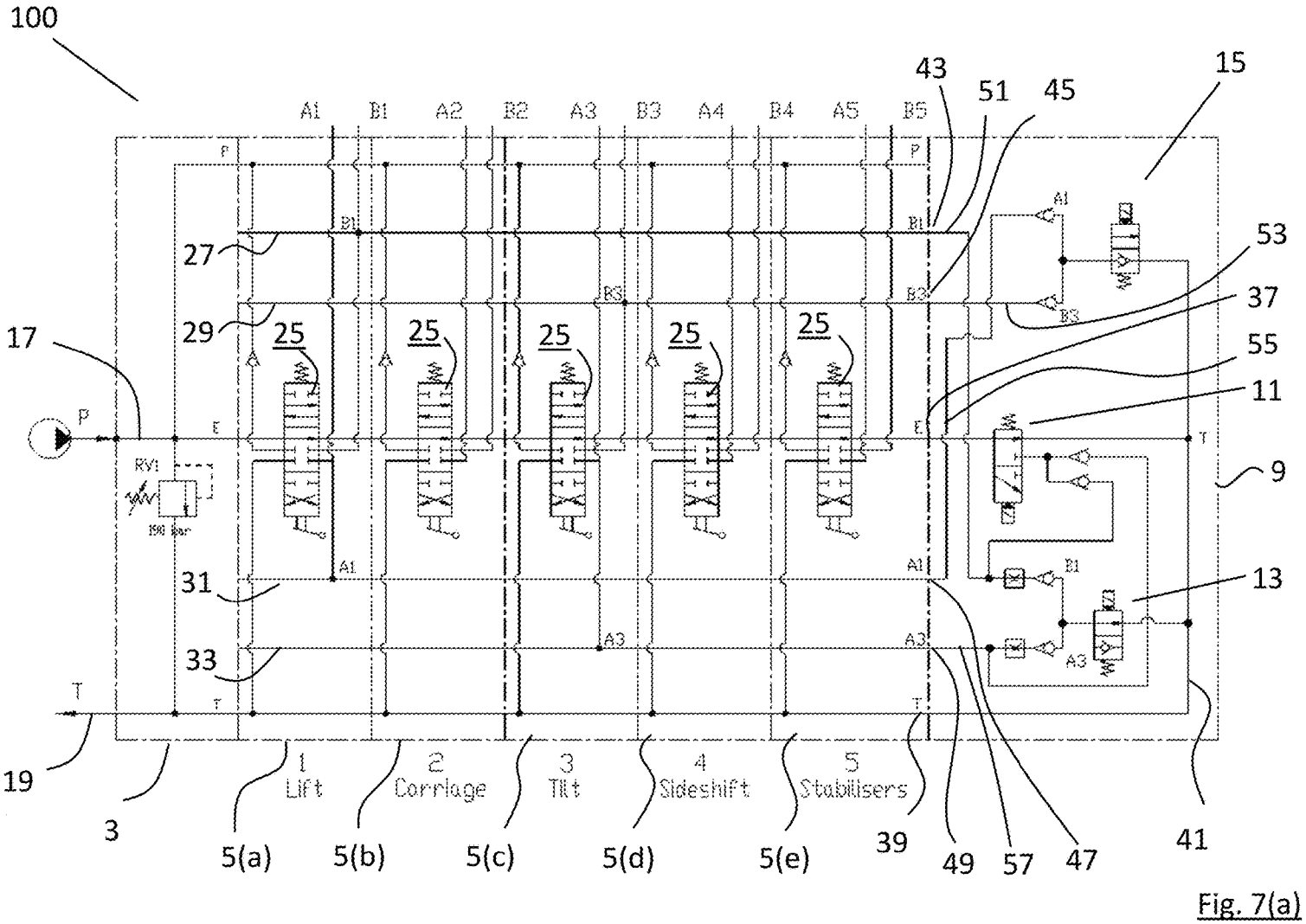
FIG. 7(*a*) is a schematic representation of the sectional hydraulic valve according to the invention in "lower and go" mode.
Figure 7B:
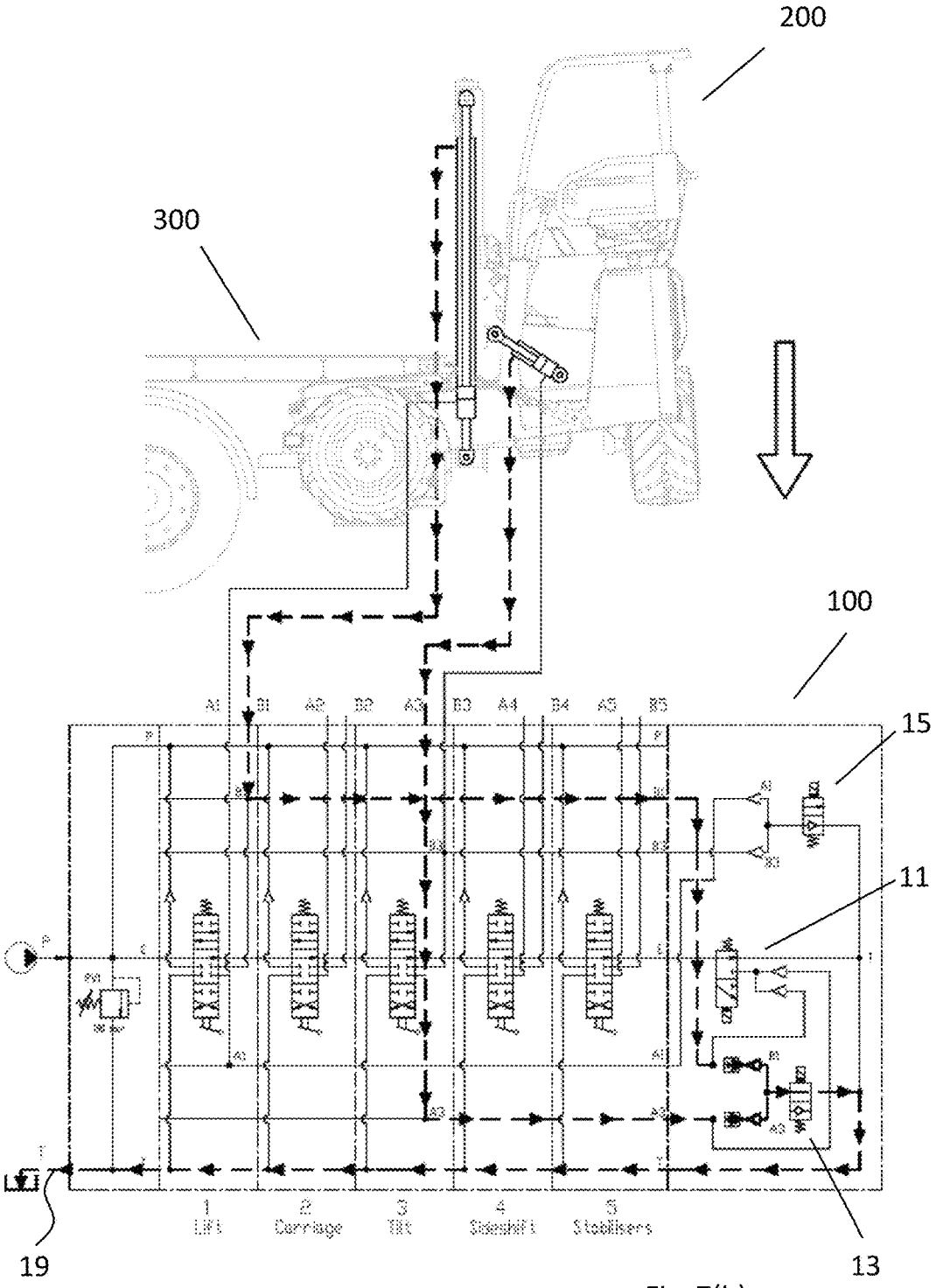

Referring now to FIG. 7(*a*), there is shown a schematic representation of the sectional hydraulic valve 100 according to the invention similar to the view shown in FIG. 4 but with the valve assembly 13 of the end cap 9 in an open configuration. Referring to FIG. 7(*b*), there is shown a diagrammatic view of the flow of hydraulic fluid in the forklift and through the sectional hydraulic valve during a "lower and go" operation. The flow of hydraulic fluid from the hydraulic sections 5(*a*) and 5(*c*) is illustrated in dotted lines.

Figure 8:
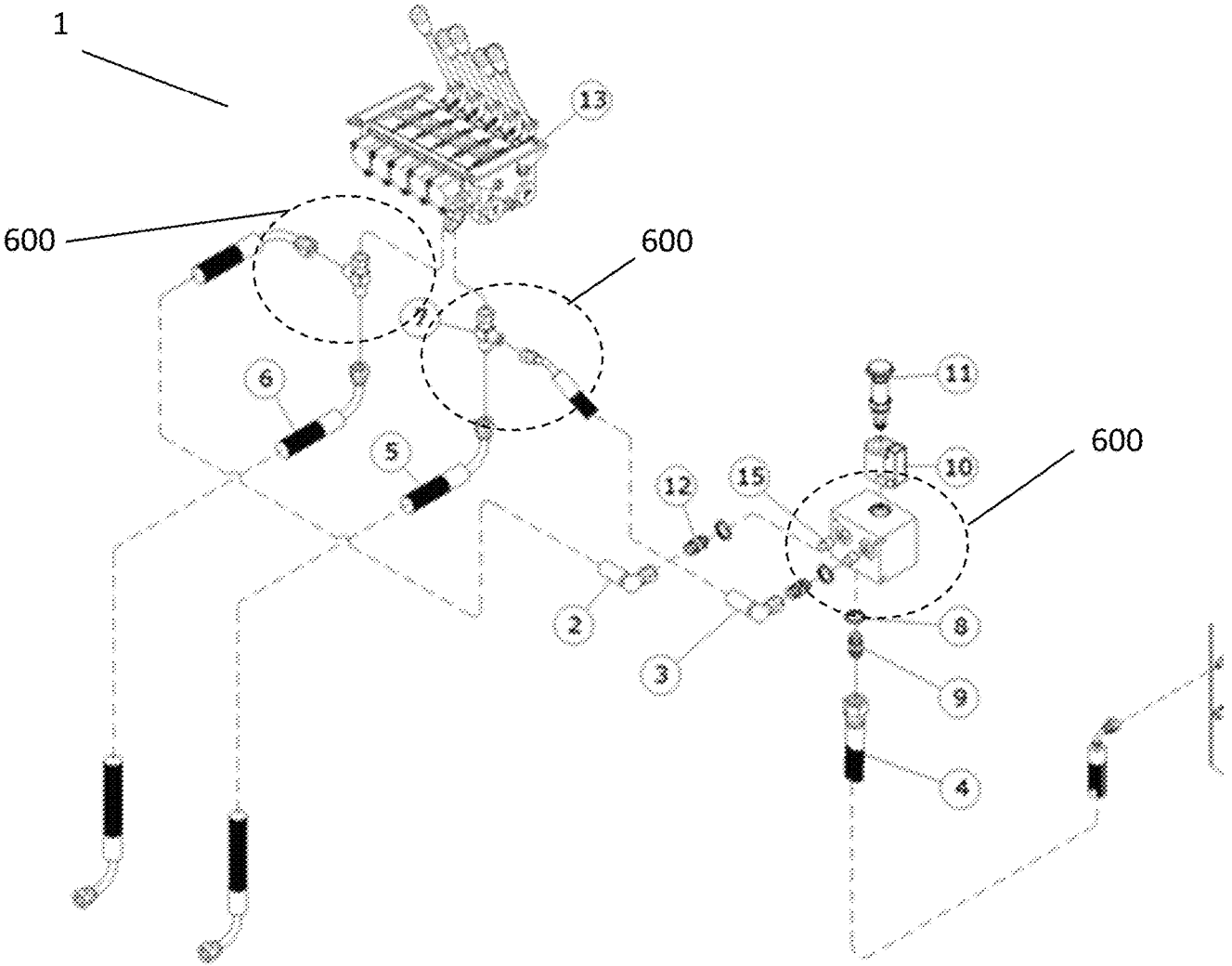
FIG. 8 is a diagrammatic view of a prior art configuration used to perform a "lower and go" operation demonstrating the leak points that have been eradicated.

Referring now to FIG. 8, there is shown a diagrammatic view of a prior art sectional hydraulic valve 1 and hydraulic piping configuration used to perform a remote "lower and go" operation. This demonstrates at least some of the leak points 600 that have been eradicated, where the leak points that have been eradicated are shown circled for convenience. It is believed that eleven unique leak points are eradicated by the implementation of the sectional hydraulic valve 100 for "lower and go" operation.

It is envisaged that the above functionality alone (i.e. "lower and go" functionality) may be all that is required in certain machines in which case it will be understood that it may not be necessary in some embodiments to provide the valve assemblies 11, 15 along with the remote pilot gallery ports 45, 47 and associated fluid passageways 53, 55. All that would be required are the passageways 41 and ports 37, 39 to allow recirculation of hydraulic fluid from the pump P to the tank T through the end cap and the passageways 51, 57, ports 43, 49 and valve assembly 13 to allow venting of the rod sides 201, 205 of the lift and tilt cylinders 203, 207.

Figure 9A:
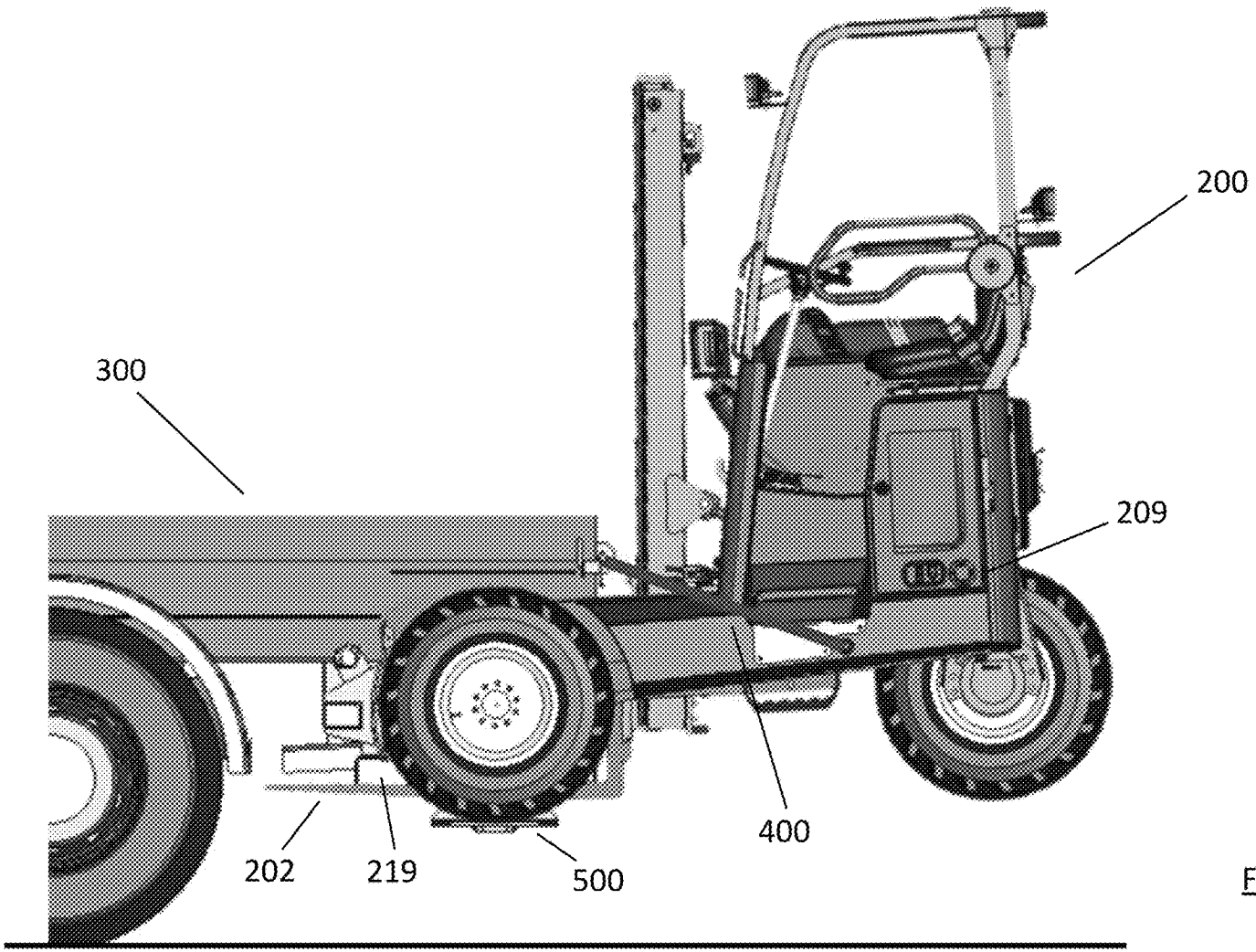
FIGS. 9(*a*) and 9(*b*) are diagrammatic views of a forklift demonstrating a "ground start" operation.
Figure 9B:
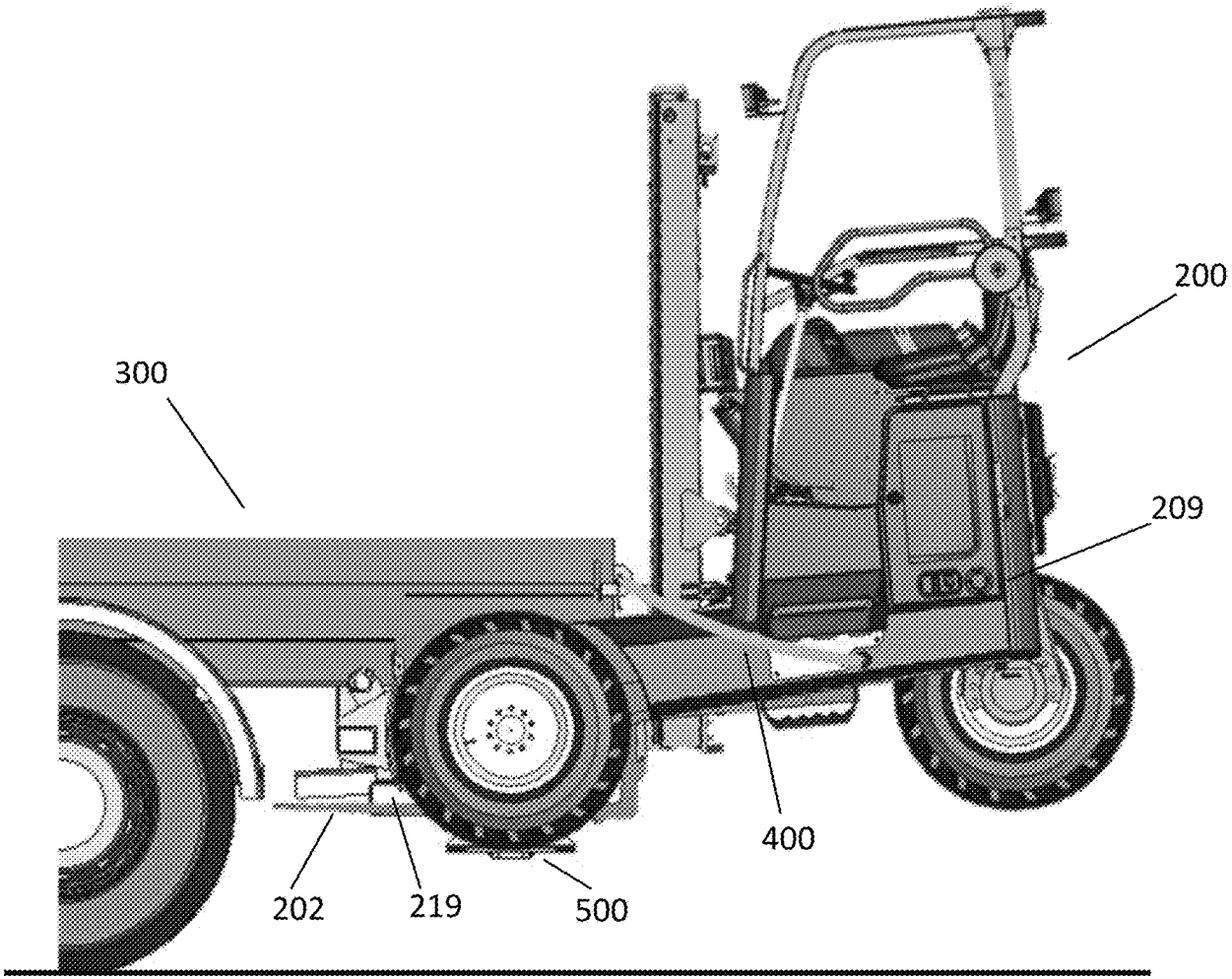

Referring now to FIGS. 9(*a*), 9(*b*) and 10, there is shown a "ground start" operation carried out on a truck mounted forklift 200, mounted on the rear of a carrying vehicle chassis 300. A "ground start" operation is almost opposite to a "lower and go" operation. The "ground start" operation is one where the forklift 200 is already mounted on the rear of the carrying vehicle and after transit, is about to be dismounted from the carrying vehicle. In order to do this, the forklift must be raised slightly and the mast must be tilted backwards slightly to take at least some of the weight onto the forks 202 and to remove the weight of the forklift off the chains 400 and at least some of the weight off the wheel rest plates 500. This is achieved by venting some of the hydraulic fluid from the bore side 215 of the lift cylinder 203 and the bore side 217 of the tilt cylinder 207 (as shown in FIG. 10)

and at the same time delivering some hydraulic fluid to the rod side 201 of the lift cylinder 203 and the rod side 205 of the tilt cylinder 207.

Referring specifically to FIG. 9(*a*), it can be seen that the chains are taut and the weight of the forklift is being supported by the chains 400 and the wheel rest plates 500. Referring to FIG. 9(*b*), the chains 400 are now slack and the weight of the forklift is at least partially being carried by the forks 202.

Figure 10:
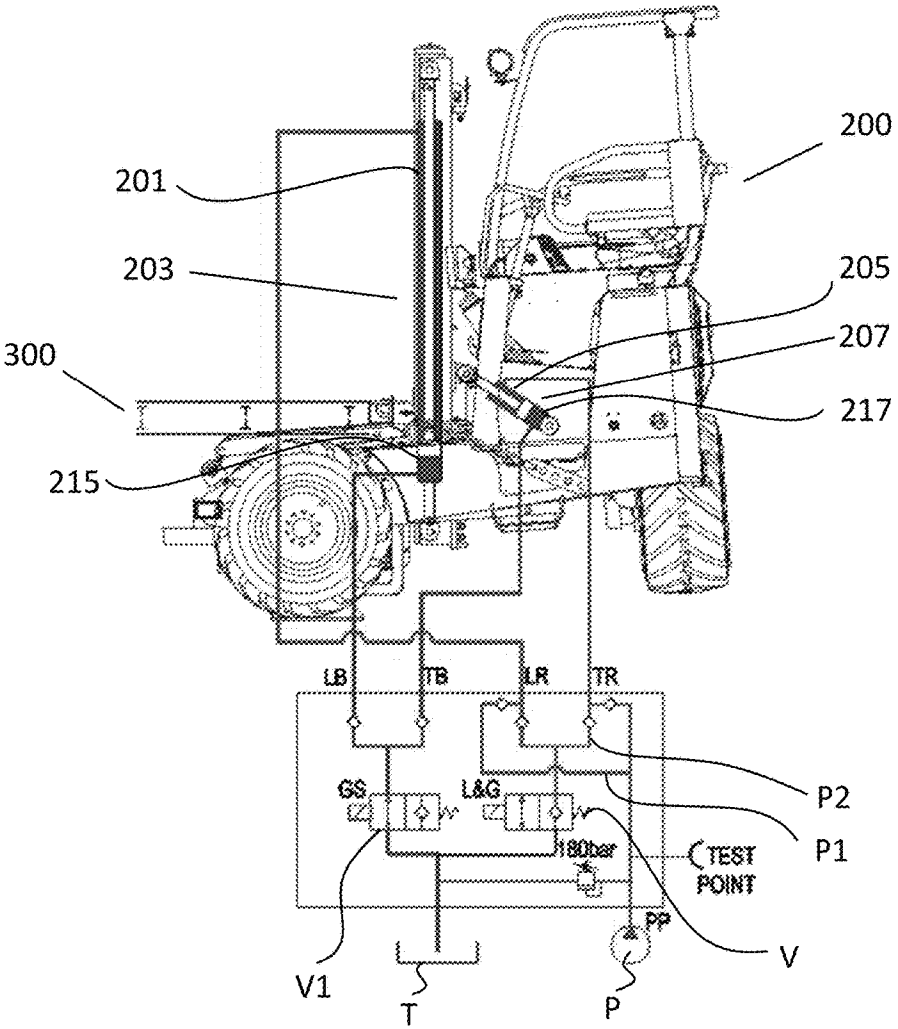
FIG. 10 is a diagrammatic view of the control of the hydraulics required to carry out a "ground start" operation.

Referring specifically to FIG. 10, there is shown a simplified diagrammatic view of the flow of hydraulic fluid required to carry out a "ground start" operation. It can be seen that the valve V of the end cap has been toggled to a "closed" configuration in which the valve V will prevent passage of hydraulic fluid therethrough to the tank, T. On the other hand, the valve V1 of the end cap has been toggled to an "open" configuration in which the valve V1 will permit passage of hydraulic fluid therethrough for subsequent return to the tank. Hydraulic fluid is passed into the fluid passageways P1, P2 and thereafter, the hydraulic fluid will travel under pressure to the rod side 201 of the lift cylinder 203 and the rod side 205 of the tilt cylinder 207.

Once hydraulic fluid is delivered into the rod side 201 of the lift cylinder 203 and the rod side 205 of the tilt cylinder 207, and vented from the bore side 215 of the lift cylinder and the bore side 217 of the tilt cylinder 207, the forks 202 will be pushed downwardly on the mast and the mast will be tilted backwards relative the forklift chassis. As the forks are pushed down the mast, the forks 202 will bear onto the fork sockets 219 on the carrying vehicle 300 causing the forklift 200 to rise upwards, thereby taking the weight of the chains 400 and allowing them to go slack. In this position, the chains can be removed before the driver climbs into the driver's station and continues with the dismounting procedure. It will be understood that by implementing this method under remote control operation, the driver will only have to climb up into the cab at height once rather than twice (a first time to start the forklift and lower the forks before dismounting to remove the chains and then climbing up for a second time once the chains are off to dismount the forklift from the truck).

Figure 11A:
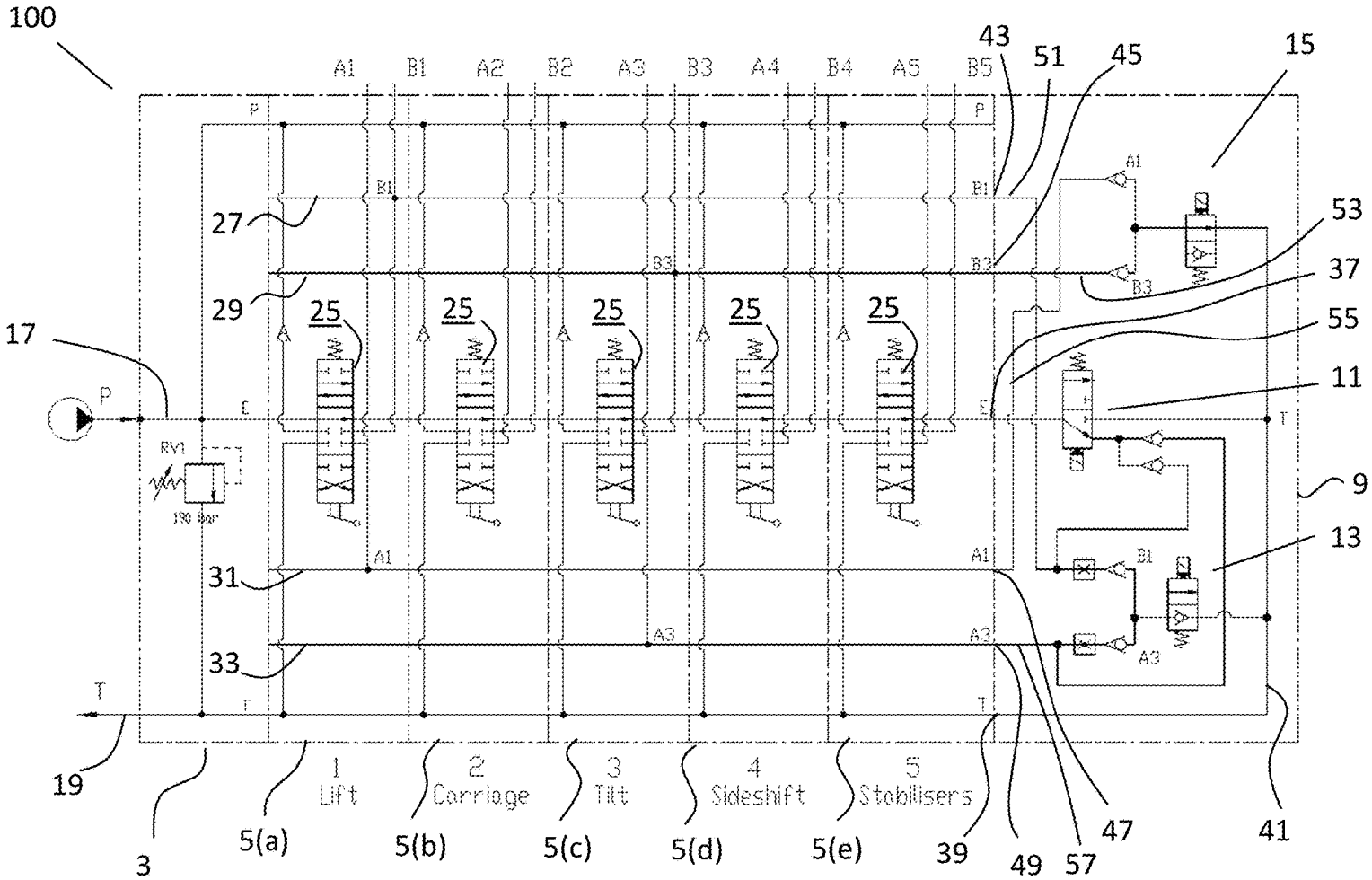
FIG. 11(*a*) is a schematic representation of the sectional hydraulic valve according to the invention in "ground start" mode.
Figure 11B:
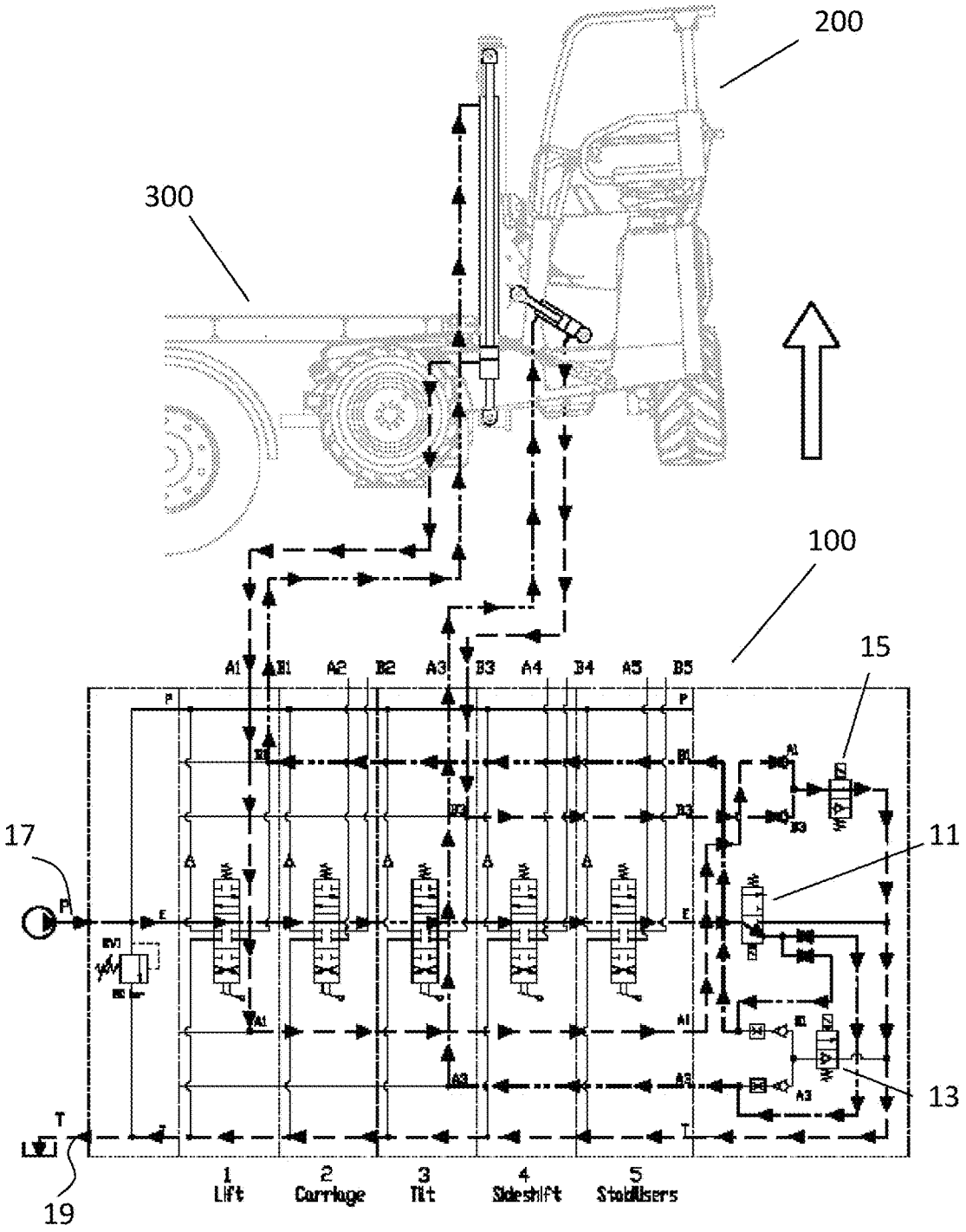

Referring now to FIG. 11(*a*), there is shown a schematic representation of the sectional hydraulic valve 100 according to the invention similar to the view shown in FIGS. 4 and 7(*a*) but with the valve assembly 15 of the end cap 9 in an open configuration, the valve assembly 13 in a closed configuration and the valve assembly 11 in a redirect configuration, redirecting the flow of hydraulic fluid coming in through the pump port 37 to the fluid passageways 51, 57 and from there to the rod side of the lift and tilt cylinders. Referring to FIG. 11(*b*), there is shown a diagrammatic view of the flow of hydraulic fluid in the forklift and through the sectional hydraulic valve during a "ground start" operation. The flow of hydraulic fluid to and from the hydraulic sections 5(*a*) and 5(*c*) is illustrated in dotted lines.

Figure 12:
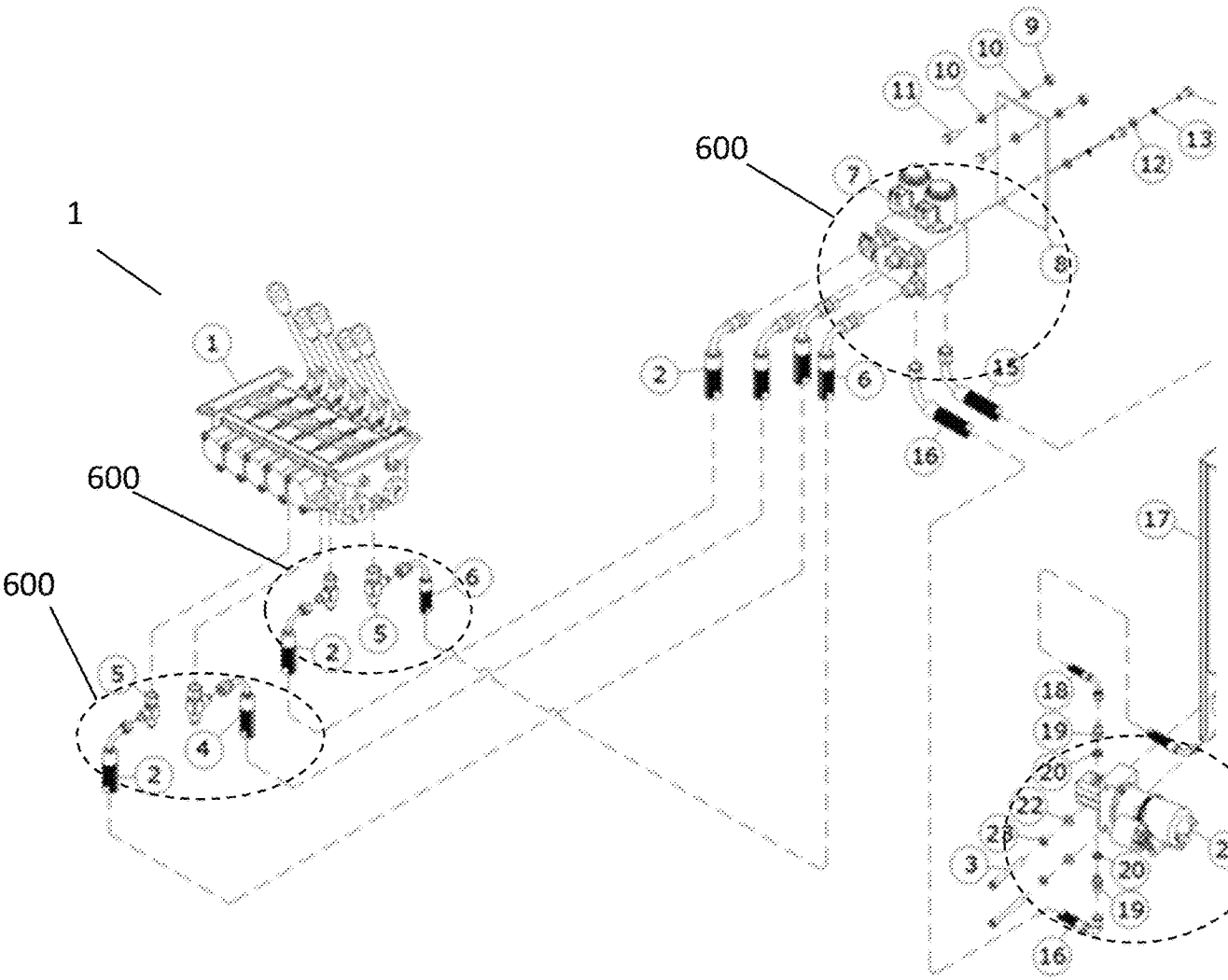
FIG. 12 is a diagrammatic view of a prior art configuration used to perform a "ground start" operation demonstrating the leak points that have been eradicated.
Figure 13A:
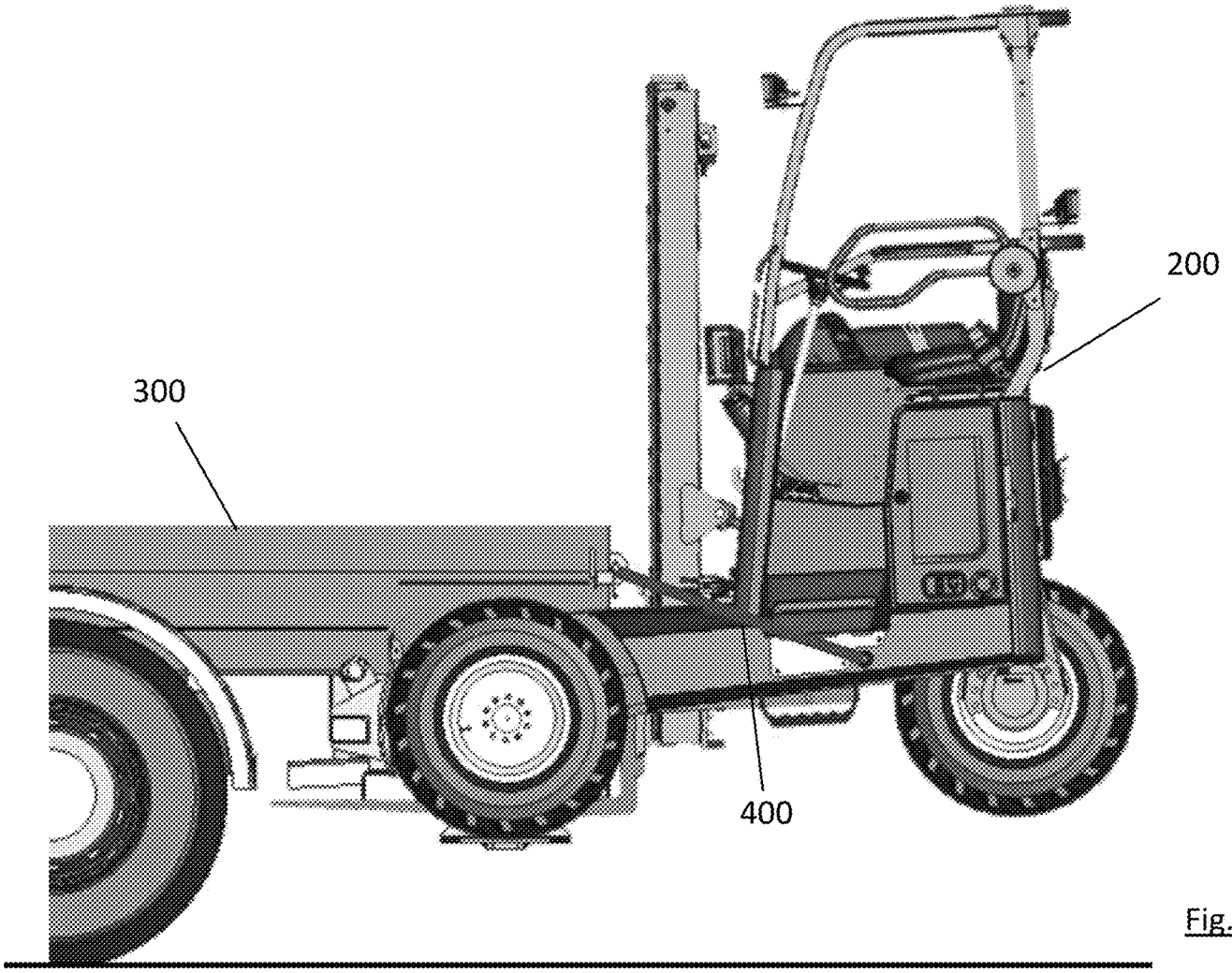
FIGS. 13(*a*) to 13(*e*) inclusive are diagrammatic views of a forklift demonstrating a "ground mount" operation.
Figure 13B:
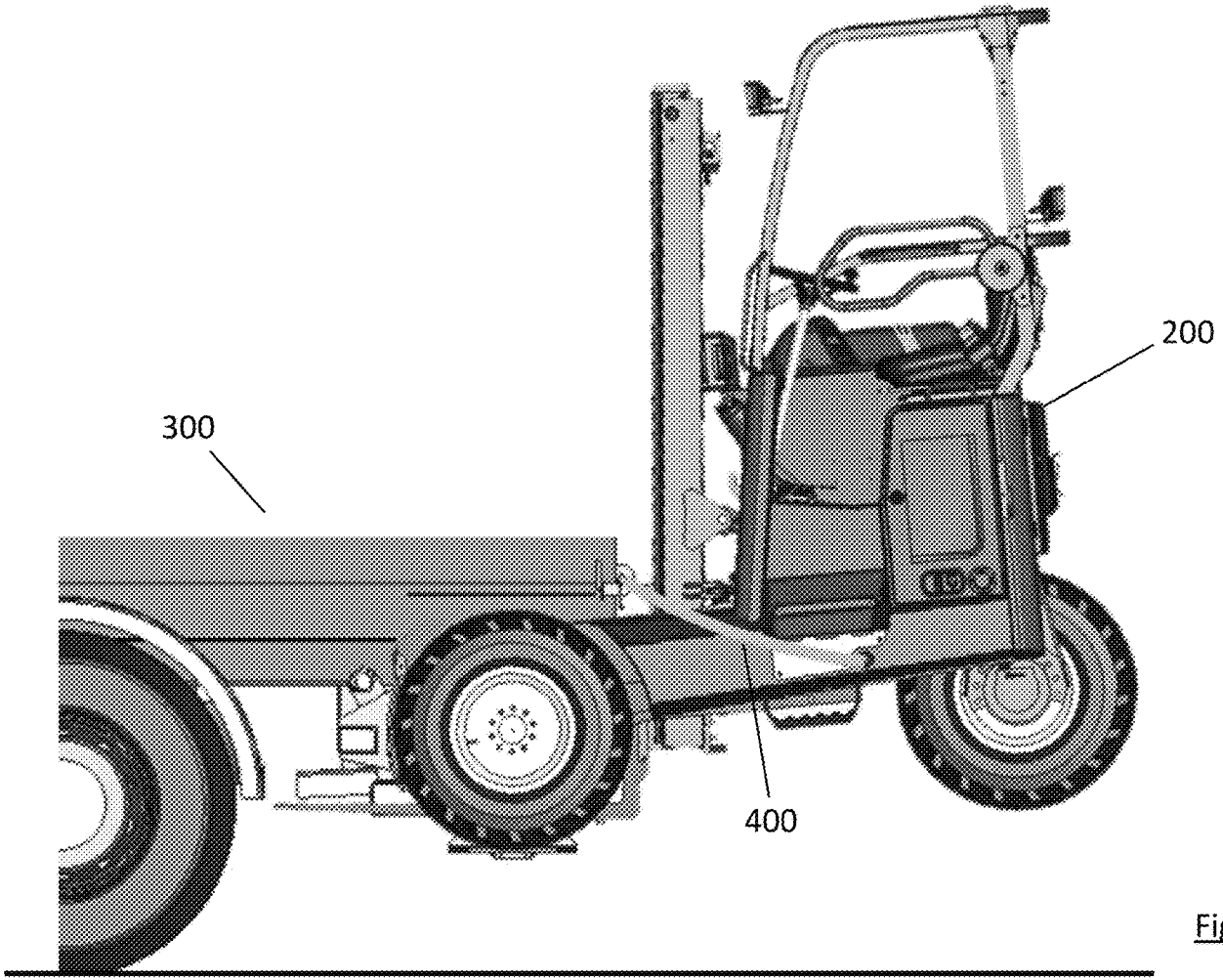
Figure 13C:
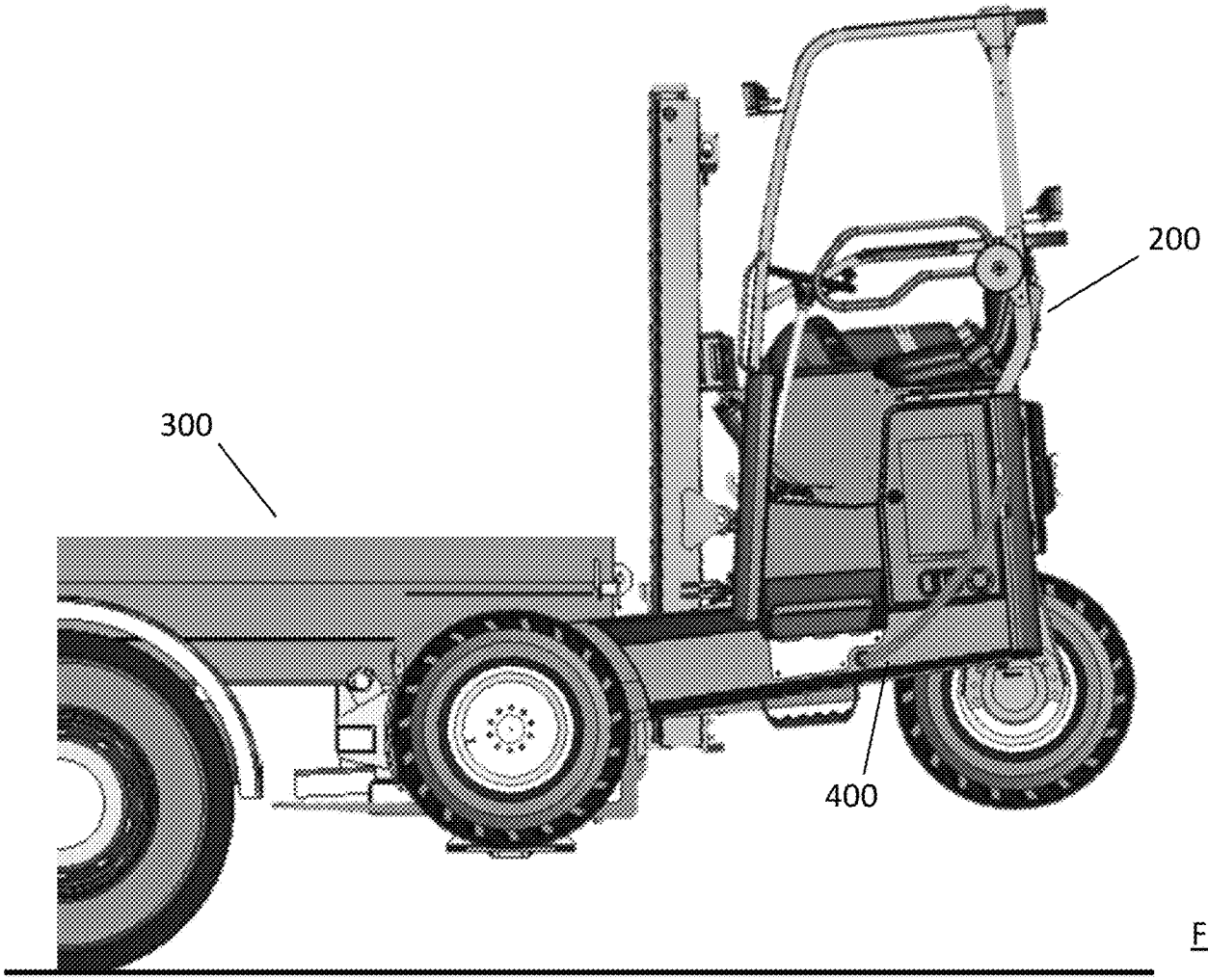
Figure 13D:
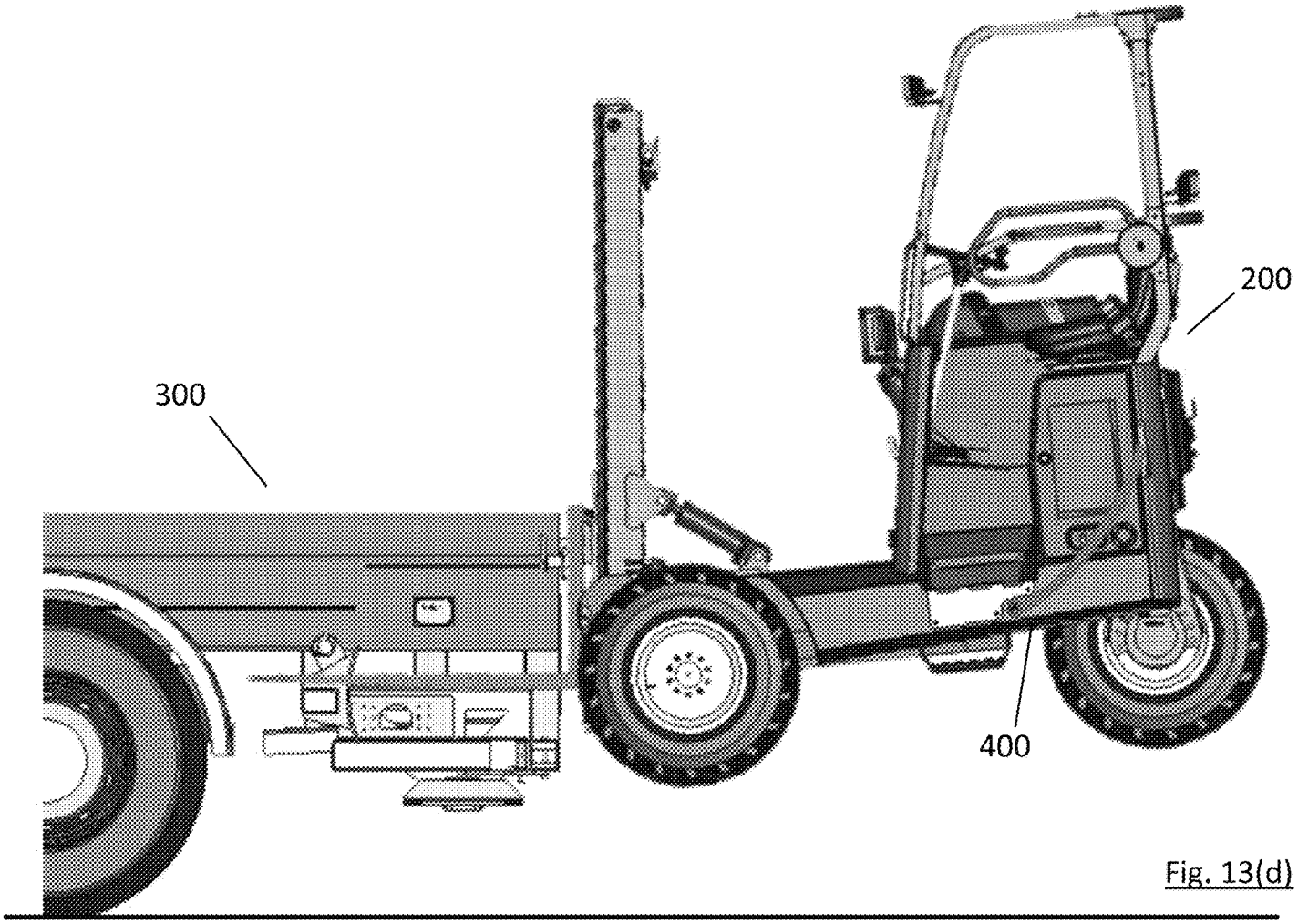
Figure 13E:
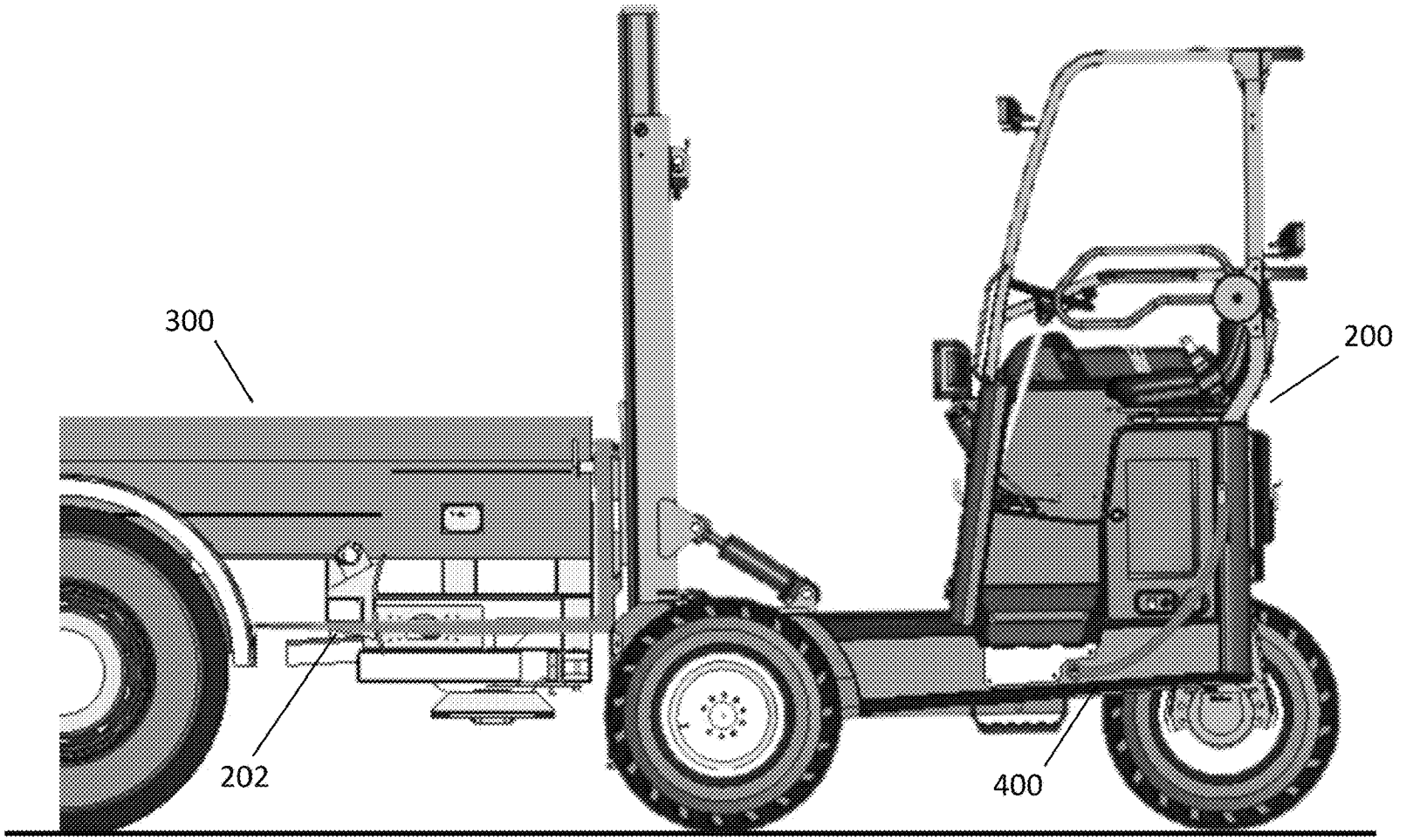

Referring now to FIG. 12, there is shown a diagrammatic view of a prior art sectional hydraulic valve 1 and hydraulic piping configuration used to perform a remote "ground start" operation. This demonstrates at least some of the leak points that have been eradicated, where the leak points that have been eradicated are shown circled for convenience. It is believed that twenty five unique leak points 600 are eradicated by the implementation of the sectional hydraulic valve 100 for a "ground start" operation.

Figure 17:
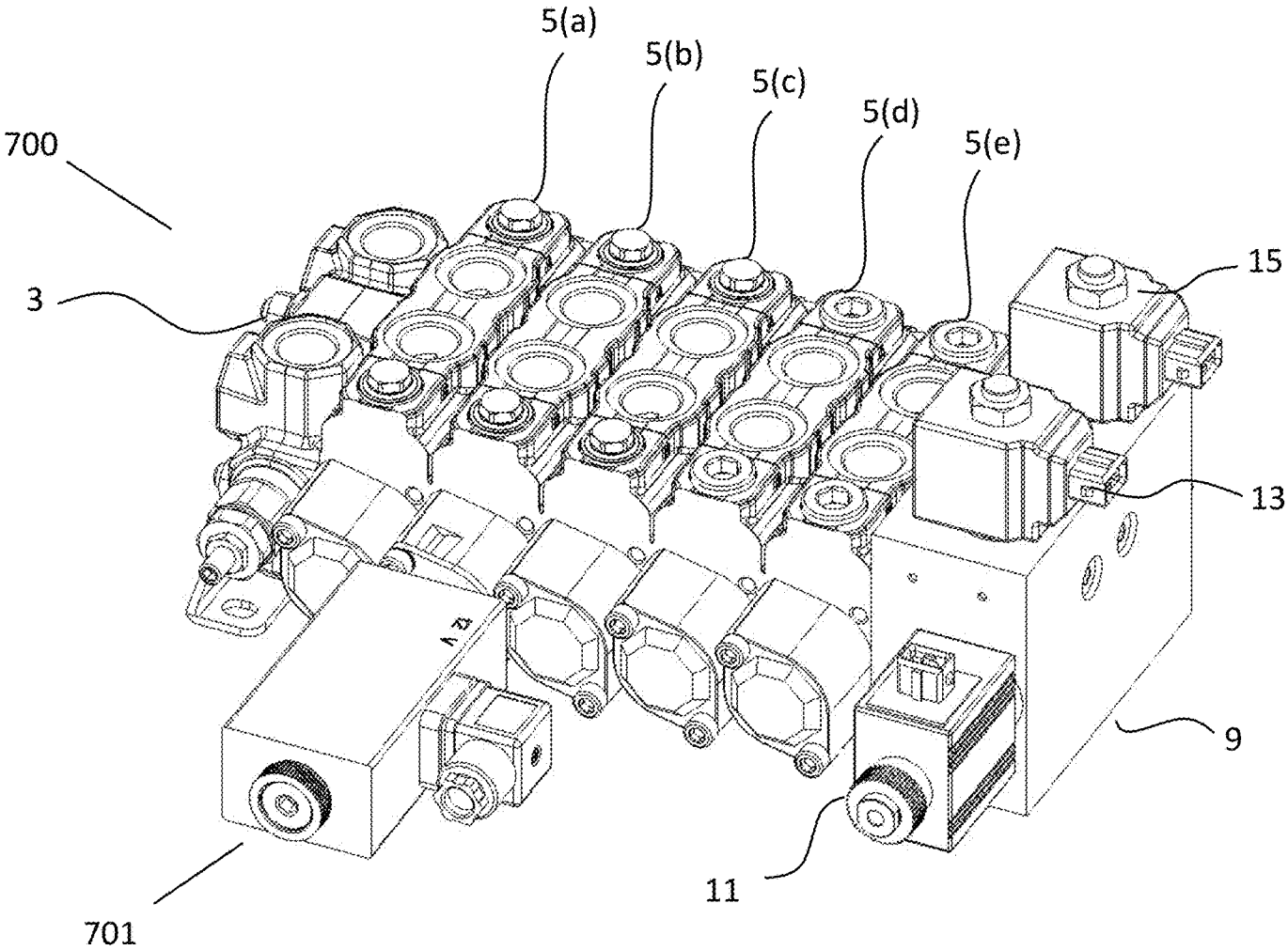
FIG. 17 is a perspective view of an alternative configuration of sectional hydraulic valve according to the invention showing the additional push/pull coil to activate a section remotely.

Referring to FIG. 17, there is shown a perspective view of an alternative configuration of sectional hydraulic valve according to the invention, indicated generally by the reference numeral 700. The sectional hydraulic valve 700 differs from the sectional hydraulic valve 100 in that there is provided an actuator 701 operable to control the spool 25 of the hydraulic section 5(*b*), namely the carriage cylinder (not shown) of the truck mounted forklift. The carriage cylinder is the cylinder that moves the entire mast assembly longitudinally backwards and forwards along the chassis of the forklift truck. In this way, it is possible to control the lift, carriage and tilt cylinders of the truck mounted forklift using a remote controller.

Referring now to FIGS. 13(*a*) to 13(*e*) inclusive, there is shown the steps of a "ground mount" operation carried out on a truck mounted forklift 200, mounted on the rear of a carrying vehicle chassis 300. A "ground mount" operation is one where, once the forks 202 have been inserted into the fork sockets 219, the entire mounting or dismounting operation can be conducted remotely by an operator from a position on the ground beside the vehicle. For simplicity, only the dismounting aspect of the "ground mount" operation is shown however it will be understood that the steps may be performed in reverse order in order to carry out a mounting operation.

Referring first of all to FIG. 13(*a*), the forklift 200 is shown mounted on the carrying vehicle with the chains 400 taut. The operator turns on the forklift engine by pressing the ignition switch 211 on the control pad 209. The forks are then lowered on the mast using switch 213 on the remote control pad 209 and the mast is tilted backwards similar to the "ground start" operation described above. In this position, as shown in FIG. 13(*b*), the chains are slack. In FIG. 13(*c*) the chains are disconnected from the carrying vehicle and stowed safely on the forklift. In step 13(*d*), the operator of the forklift 200 has pressed another button (not shown) on the remote control pad 209 which causes the actuator 701 to operate the carriage cylinder. Hydraulic fluid is delivered to the carriage cylinder to move the mast forward along the forklift chassis. As the forks 202 are trapped in the fork sockets 219 on the carrying vehicle chassis 300, the whole body of the forklift moves rearwardly instead until the wheels of the forklift are off the wheel rest pads 500 and the majority of the forklift is rearward of the carrying vehicle as illustrated in FIG. 13(*d*). Once in this position, the forklift is then lowered downwards by the operator pressing the button 213 on the control pad 209 to vent hydraulic fluid from the rod sides of both the lift cylinder and the tilt cylinder (it will be understood that hydraulic fluid may simultaneously be delivered into the bore side of both the lift cylinder 203 and the tilt cylinder 207 as it is vented from the rod sides 201, 205 in order to provide a controlled descent). As the majority of the forklift is free of the carrying vehicle (with the exception of the forks 202 in the fork sockets 219), the forklift will slowly be lowered to the ground to the position shown in FIG. 13(*e*) and the forklift will pivot rearwardly as the mast is able to tilt forwards.

Figure 14:
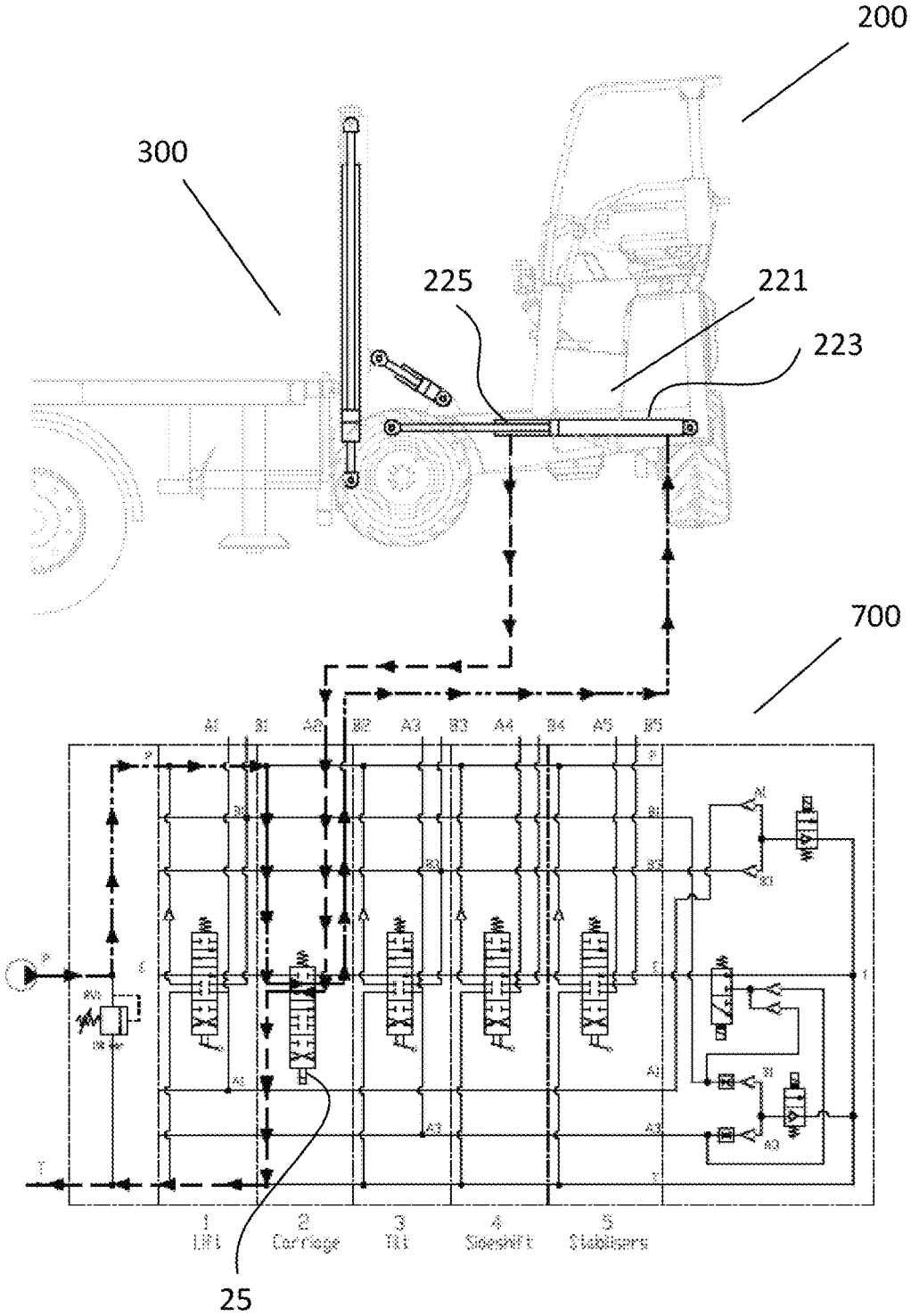
FIG. 14 is a schematic representation of the sectional hydraulic valve according to the invention performing part of "ground mount" operation.
Figure 15:
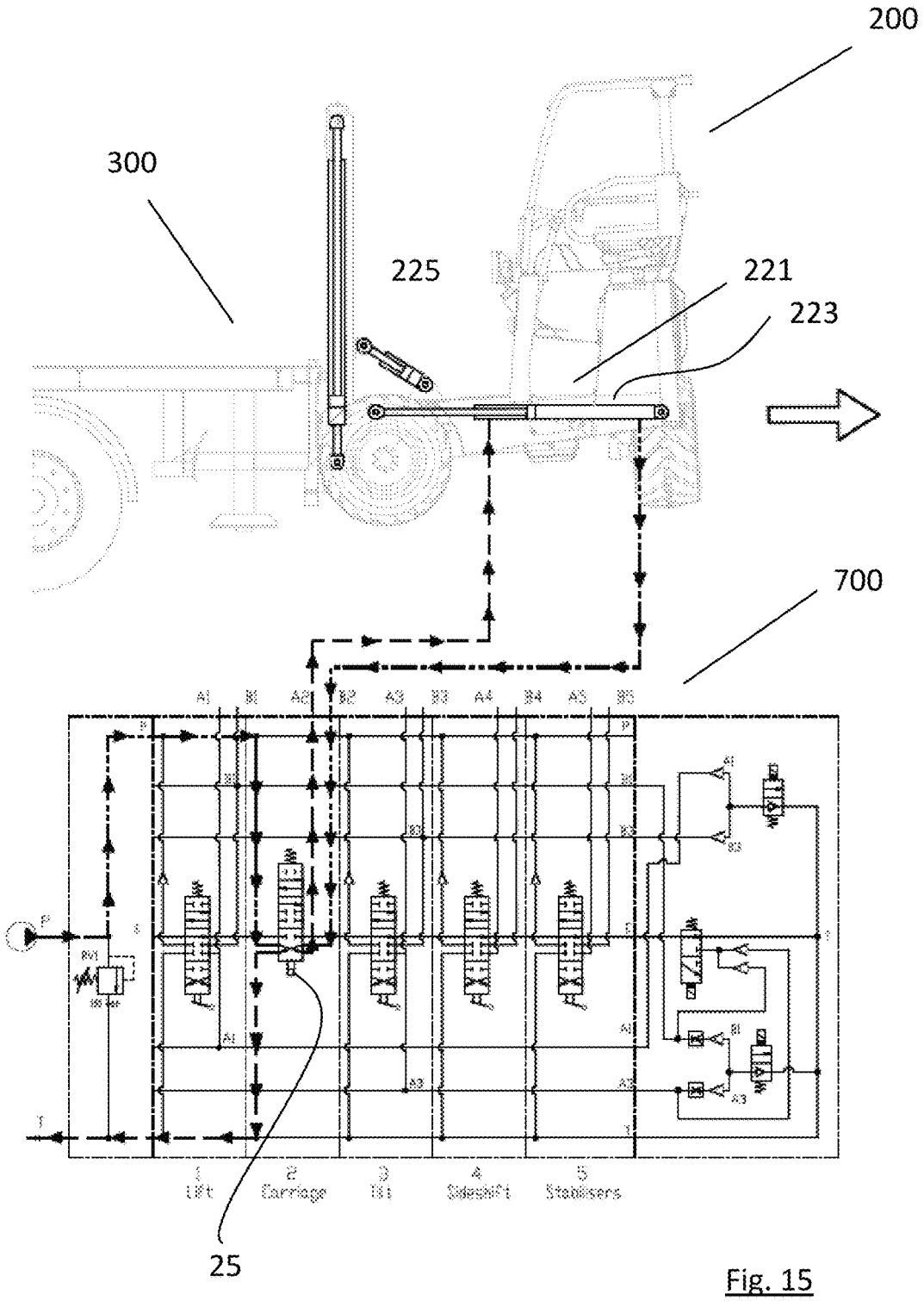
FIG. 15 is a schematic representation of the sectional hydraulic valve according to the invention performing part of "ground mount" operation.

Referring now to FIGS. 14 and 15, there is shown a schematic representation of the sectional hydraulic valve 700 according to the invention operating the carriage cylinder 221 as part of a "ground mount" mode. In FIG. 14, the actuator (not shown) operable to control the spool 25 of the hydraulic section 5(*b*) is operated so that hydraulic fluid is delivered into the bore side 221 of the carriage cylinder and vented from the rod side 225 of the carriage cylinder. By doing so, the forklift will be moved rearwards to a position free of the trailer. In FIG. 15, the actuator (not shown) operable to control the spool 25 of the hydraulic section 5(*b*) is operated so that hydraulic fluid is delivered into the rod side 225 of the carriage cylinder and vented from the bore side 223 of the carriage cylinder. This will have the effect of drawing the forklift closer to the carrying vehicle. This movement is achieved using an actuator operating the spool 25 however it will be understood that this could be done equally well by delivering/venting hydraulic fluid through a pilot gallery if a pair of pilot galleries were connected to the A port and the B port of the carriage cylinder. It will be understood from the foregoing description how the further manipulation of the lift and tilt cylinders can be achieved in order to place the forklift in either a mounted or dismounted position.

Figure 16:
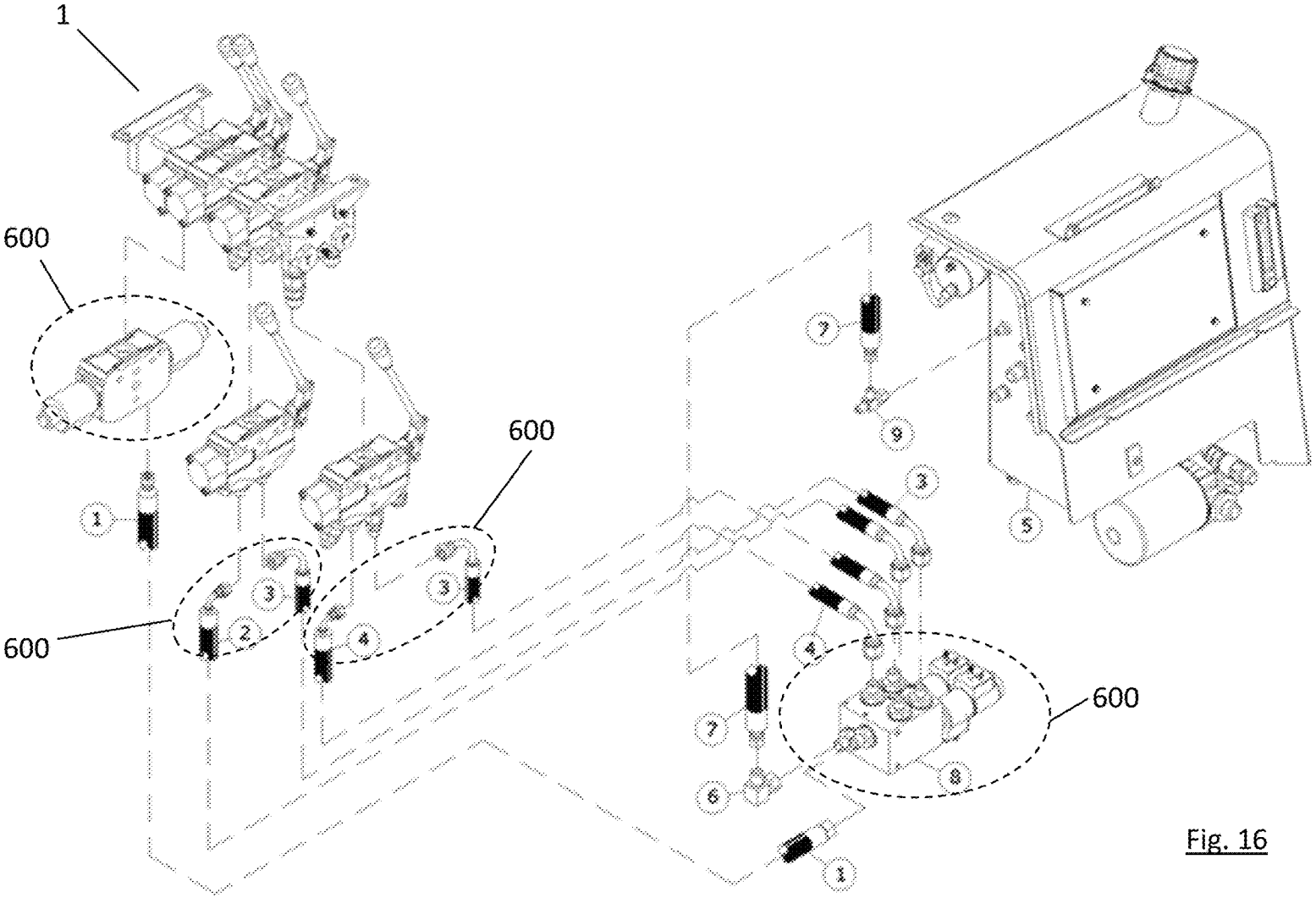
FIG. 16 is a diagrammatic view of a prior art configuration used to perform a "ground mount" operation demonstrating the leak points that have been eradicated.

Referring now to FIG. 16, there is shown a diagrammatic view of a prior art sectional hydraulic valve 1 and hydraulic piping configuration used to perform a remote "ground mount" operation. This demonstrates at least some of the leak points that have been eradicated, where the leak points that have been eradicated are shown circled for convenience. It is believed that thirty unique leak points 600 are eradicated by the implementation of the sectional hydraulic valve 100.

It will be understood that in the examples, only two hydraulic sections 5(*a*)-5(*e*) are shown controlled by delivery or withdrawal of fluid through the remote pilot galleries. This is due to the fact that further remote pilot galleries would weaken the structure of the hydraulic sections shown. It is envisaged that alternative configurations of hydraulic sections could be used with more or less remote pilot galleries and therefore more or less than two hydraulic sections can be controlled in this manner. Furthermore, alternative valve arrangements could be provided to achieve the same result.

Throughout the specification and claims, reference may be made to a first, second, third, fourth, fifth and sixth remote pilot gallery, a first, second, third, fourth, fifth and sixth remote pilot gallery port, and a first, second, third, fourth, fifth and sixth fluid passageway for simplicity and to differentiate between the remote pilot galleries, the remote pilot gallery ports and the fluid passageways. It will be understood that unless otherwise specified or claimed, when reference is made to the third, fourth, fifth or sixth gallery, this is not intended to strictly imply that there is necessarily a second, third, fourth or fifth gallery. For example, there may be a first and third remote pilot gallery, a first and third remote pilot gallery port and a first and third fluid passageway without a second remote pilot gallery, a second remote pilot gallery port and a second fluid passageway. Similarly, there may be a first, second, third and fifth (for example) remote pilot gallery, a first, second, third and fifth remote pilot gallery port, and a first, second, third and fifth fluid passageway without a fourth remote pilot gallery, a fourth remote pilot gallery port and a fourth fluid passageway.

In this specification the terms "comprise, comprises, comprised and comprising" and the terms include, includes, included and including" are all deemed totally interchangeable and should be afforded the widest possible interpretation.

The invention is not limited to the embodiments hereinbefore described but may be varied in both construction and detail within the scope of the appended claims.

The invention claimed is:

1. A sectional hydraulic valve of the type comprising an inlet cover, a plurality of hydraulic sections and an end cap;

the hydraulic sections each having a pump gallery, a tank gallery, an A port, a B port, a spool for selectively coupling one of the A port and the B port to the pump gallery and the other of the A port and the B port to the tank gallery, a first remote pilot gallery, the first remote pilot gallery being operatively coupled to one of the A port and the B port of a first one of the hydraulic sections, and a second remote pilot gallery, the second remote pilot gallery being operatively coupled to the other of the A port and the B port of the first one of the hydraulic sections;

the end cap comprising a pump port coupled to the pump gallery, a tank port coupled to the tank gallery and a connecting conduit between the pump port and the tank port;

and in which the end cap further comprises:

a first remote pilot gallery port coupled to the first remote pilot gallery; a fluid passageway between the first remote pilot gallery port and the connecting conduit;

a second remote pilot gallery port coupled to the second remote pilot gallery; a second fluid passageway between the second remote pilot gallery port and the connecting conduit; and a valve assembly operable to selectively permit or restrict flow of hydraulic fluid between the connecting conduit in the end cap and the remote pilot galleries in the first one of the hydraulic sections.

2. The sectional hydraulic valve as claimed in claim 1 in which:

the hydraulic sections each comprise a third remote pilot gallery, the third remote pilot gallery being operatively coupled to one of the A port and the B port of a second one of the hydraulic sections; and a fourth remote pilot gallery, the fourth remote pilot gallery being operatively coupled to the other of the A port and the B port of the second one of the hydraulic sections; and the end cap further comprises:

a third remote pilot gallery port coupled to the third remote pilot gallery; a third fluid passageway between the third remote pilot gallery port and the connecting conduit;

a fourth remote pilot gallery port coupled to the fourth remote pilot gallery; a fourth fluid passageway between the fourth remote pilot gallery port and the connecting conduit; and the valve assembly being operable to selectively permit or restrict flow of hydraulic fluid between the connecting conduit in the end cap and the remote pilot galleries in the second one of the hydraulic sections.

3. The sectional hydraulic valve as claimed in claim 2 in which the first and third fluid passageways are led to a common valve in the valve assembly.

4. The sectional hydraulic valve as claimed in claim 3 in which the second and fourth fluid passageways are led to a common valve in the valve assembly.

5. The sectional hydraulic valve as claimed in claim 1 in which the valve in the valve assembly comprises at least one spool.

6. The sectional hydraulic valve as claimed in claim 5 in which the at least one spool is operated by way of a dedicated solenoid.

7. The sectional hydraulic valve as claimed in claim 1 in which the valve assembly comprises a spool operable to selectively redirect the hydraulic fluid in the connecting conduit away from the tank port to one or more of the remote pilot galleries.

8. The sectional hydraulic valve as claimed in claim 1 in which there is provided a remotely controllable secondary actuator connected to the spool of another of the hydraulic sections.

9. The sectional hydraulic valve as claimed in claim 8 in which the remotely controllable secondary actuator comprises a solenoid.

10. A sectional hydraulic valve as claimed in claim 2 in which:

the hydraulic sections each comprise a fifth remote pilot gallery, the fifth remote pilot gallery being operatively coupled to one of the A port and the B port of a third one of the hydraulic sections; and a sixth remote pilot gallery, the sixth remote pilot gallery being operatively coupled to the other of the A port and the B port of the third one of the hydraulic sections; and the end cap further comprises:

a fifth remote pilot gallery port coupled to the fifth remote pilot gallery; a fifth fluid passageway between the fifth remote pilot gallery port and the connecting conduit;

a sixth remote pilot gallery port coupled to the sixth remote pilot gallery; a sixth fluid passageway between the sixth remote pilot gallery port and the connecting conduit; and the valve assembly being operable to selectively permit or restrict flow of hydraulic fluid between the connecting conduit in the end cap and the remote pilot galleries in the third one of the hydraulic sections.

11. A truck mounted forklift for mounting on the rear of a vehicle, the truck mounted forklift comprising a u-shaped chassis having a pair of forwardly projecting side bars bridged by a rear crossbar, a wheel adjacent the forwardmost end of each of the side bars and a rear wheel mounted on the rear cross bar, a driver's station mounted to one side of the chassis, a motive power unit mounted on the other side of the chassis and a lifting assembly mounted on the chassis, the lifting assembly being operated by a plurality of hydraulic cylinders, a primary control panel for the hydraulics located internal the driver's station and a secondary control panel for control of the hydraulics located remotely from the primary control panel of the forklift truck, the secondary hydraulics control panel being positioned in a location accessible by a forklift operator in a position dismounted from the forklift, and in which the hydraulic fluid to and from the plurality of hydraulic cylinders is routed through the sectional hydraulic valve as claimed in any preceding claim.

12. The truck mounted forklift as claimed in claim 11 in which the secondary control panel comprises an ignition switch and a switch to vent hydraulic fluid from the rod side of a lift cylinder and the rod side of a tilt cylinder of the lifting assembly using the sectional hydraulic valve.

13. The truck mounted forklift as claimed in claim 12 in which the secondary control panel comprises a switch to deliver hydraulic fluid to the rod side of the lift cylinder and the rod side of the tilt cylinder and vent hydraulic fluid from the bore side of the lift cylinder and the bore side of the tilt cylinder using the sectional hydraulic valve.

14. The truck mounted forklift as claimed in claim 12 in which the secondary control panel comprises a switch to deliver hydraulic fluid to the bore side of the lift cylinder and the bore side of the tilt cylinder and vent hydraulic fluid from the rod side of the lift cylinder and the rod side of the tilt cylinder using the sectional hydraulic valve.

15. The truck mounted forklift as claimed in claim 13 in which the secondary control panel comprises a switch to deliver hydraulic fluid to the bore side of the lift cylinder and the bore side of the tilt cylinder and vent hydraulic fluid from the rod side of the lift cylinder and the rod side of the tilt cylinder using the sectional hydraulic valve.

16. The truck mounted forklift as claimed in claim 12 in which the secondary control panel comprises a switch to operate a remotely controllable secondary actuator connected to the spool of one of the hydraulic sections of the sectional hydraulic valve.

17. The truck mounted forklift as claimed in claim 13 in which the secondary control panel comprises a switch to operate a remotely controllable secondary actuator connected to the spool of one of the hydraulic sections of the sectional hydraulic valve.

18. The truck mounted forklift as claimed in claim 14 in which the secondary control panel comprises a switch to operate a remotely controllable secondary actuator connected to the spool of one of the hydraulic sections of the sectional hydraulic valve.

19. The truck mounted forklift as claimed in claim 15 in which the secondary control panel comprises a switch to operate a remotely controllable secondary actuator connected to the spool of one of the hydraulic sections of the sectional hydraulic valve.

* * * * *